US010773372B2

(12) United States Patent
Jovanovich

(10) Patent No.: US 10,773,372 B2
(45) Date of Patent: Sep. 15, 2020

(54) SCALE ATTACHMENT SYSTEM FOR KNIFE WITH REMOVABLE SCALES

(71) Applicant: Todd Jovanovich, Arlington, WA (US)

(72) Inventor: Todd Jovanovich, Arlington, WA (US)

( * ) Notice: Subject to any disclaimer, the term of this patent is extended or adjusted under 35 U.S.C. 154(b) by 0 days.

(21) Appl. No.: 16/039,250

(22) Filed: Jul. 18, 2018

(65) Prior Publication Data

US 2020/0023509 A1 Jan. 23, 2020

(51) Int. Cl.
*B25G 3/36* (2006.01)
*B26B 1/02* (2006.01)
*B26B 3/00* (2006.01)

(52) U.S. Cl.
CPC ..... *B25G 3/36* (2013.01); *B26B 1/02* (2013.01); *B26B 3/00* (2013.01)

(58) Field of Classification Search
CPC ..... B26B 11/00; B26B 3/00; B26B 1/042; B26B 1/04; B26B 11/003; B26B 11/006; B26B 11/001; B67B 7/16
USPC ..... 30/155, 165, 344, 351, 340, 342, 343, 30/355; D7/649, 650, 652; D22/118
See application file for complete search history.

(56) References Cited

U.S. PATENT DOCUMENTS 1,485,571 A * 3/1924 Stevens ..... B25G 3/26 30/342
2,170,537 A 8/1939 Mirando et al.
2,284,833 A 6/1942 Mirando et al.
2,467,481 A * 4/1949 Huff ..... B26B 5/00 30/339
2,476,995 A 7/1949 Mirando
2,479,855 A 8/1949 Mirando
2,529,618 A * 11/1950 Slavsky ..... B26B 5/00 30/344
3,266,081 A * 8/1966 Heim ..... B25G 1/00 16/110.1
4,730,393 A 3/1988 Coburn
5,694,692 A 12/1997 Reinschreiber
8,745,878 B2 6/2014 Glesser
9,636,829 B2 5/2017 Taylor
2012/0017442 A1 1/2012 King
2014/0198485 A1* 7/2014 Karchon ..... B26B 11/008 362/119
2015/0217461 A1 8/2015 Langenwalter et al.
2015/0239136 A1 8/2015 Taylor

OTHER PUBLICATIONS

"SpearPoint Knife Handles/Scales", Lumberjocks Woodworking Showcase, May 2015, Retrieved at http://lumberjocks.com/projects/150578.

* cited by examiner

*Primary Examiner* — Ghassem Alie
(74) *Attorney, Agent, or Firm* — Dorsey & Whitney LLP

(57) ABSTRACT

The disclosure is related to knives (fixed blade or folding) with removable scales and scale attachment systems for such knives. In accordance with some examples herein a scale attachment system for a knife having a blade and a handle defined, at least in part, by a pair of scales removably attached to the blade, includes a plurality of U-shaped clips, each of which is configured to be received in a pair of corresponding grooves on opposite sides of the handle. In examples herein, each of the clips may extend transversely along a spine side of the handle and at least along a portion of the two opposite sides of the handle adjacent to the spine side.

20 Claims, 25 Drawing Sheets

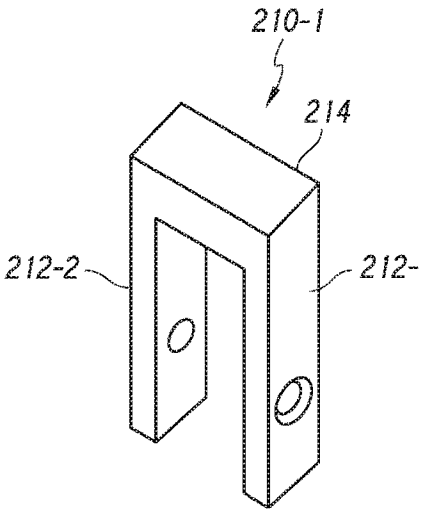
FIG. 25-A
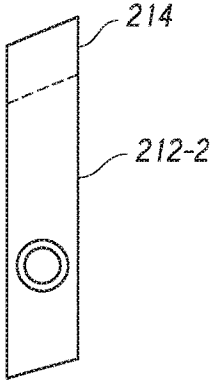
FIG. 25-B
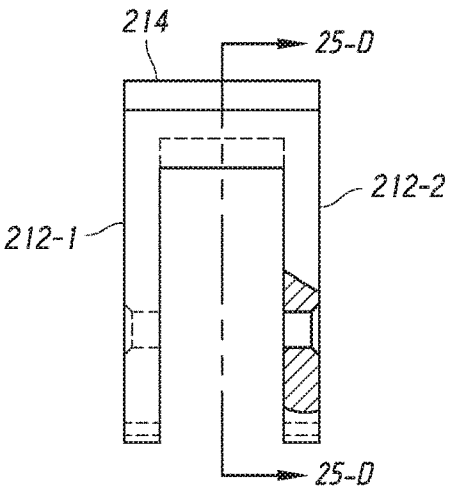
FIG. 25-C
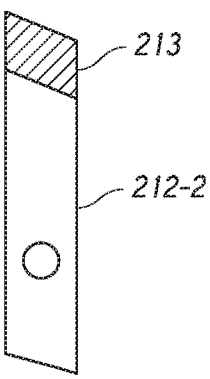
FIG. 25-D
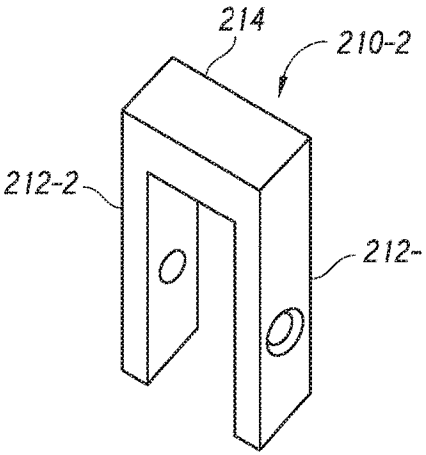
FIG. 26-A
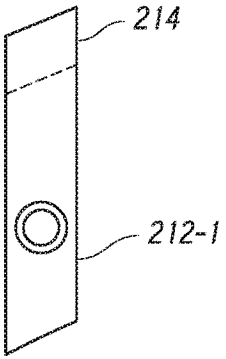
FIG. 26-B
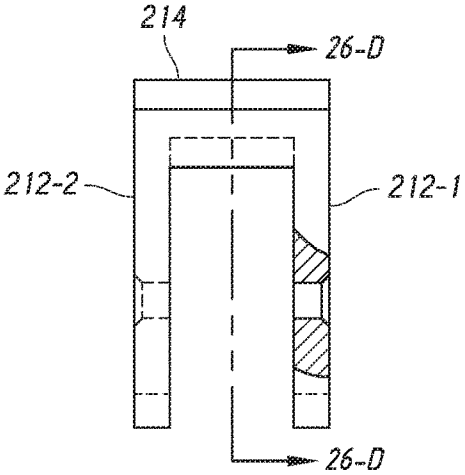
FIG. 26-C
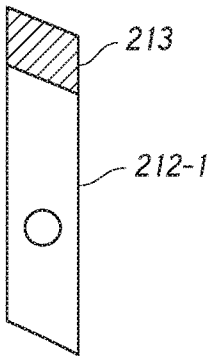
FIG. 26-D

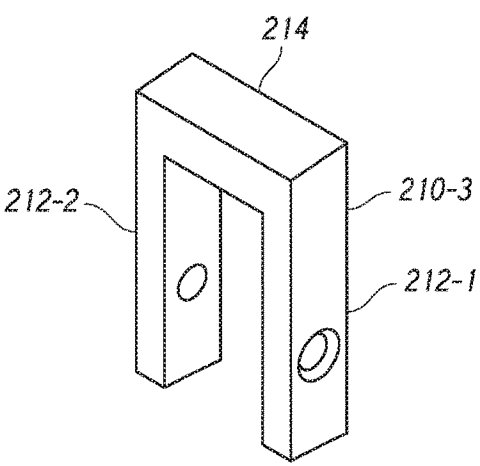
FIG. 27-A
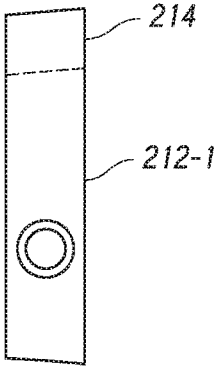
FIG. 27-B
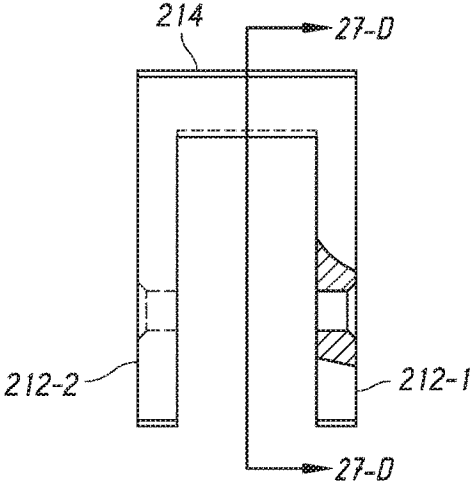
FIG. 27-C
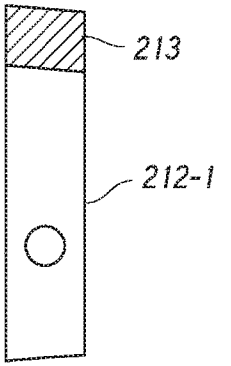
FIG. 27-D
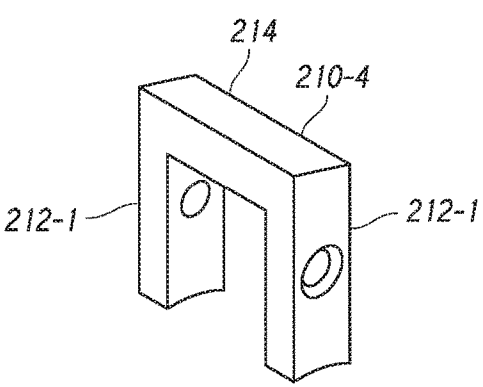
FIG. 28-A
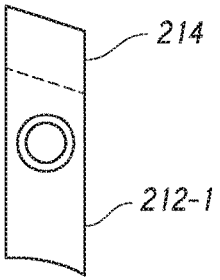
FIG. 28-B
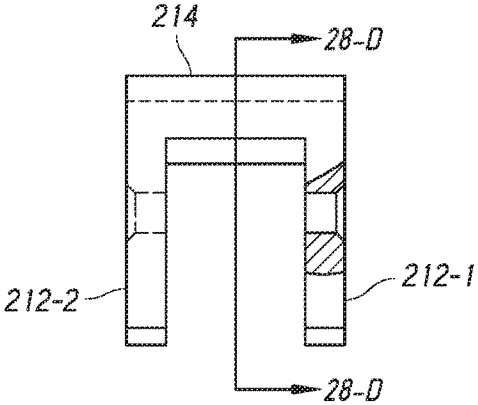
FIG. 28-C
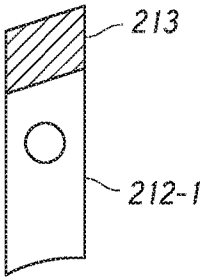
FIG. 28-D

SCALE ATTACHMENT SYSTEM FOR KNIFE WITH REMOVABLE SCALES

TECHNICAL FIELD

The present disclosure pertains to a scale attachment system for knives with interchangeable scales.

BACKGROUND

A knife is a tool with a cutting edge or blade. Knives of different types, designs, and for different uses have been developed, such as kitchen knives (e.g., paring knives, carving knives, and/or chefs knives), or other types of knives which can be used as a tool or weapon (e.g., a pocket knife, scalpel, switchblade, utility knife, and/or hunting knife). A knife typically has a blade and a handle, the handle generally being formed by two pieces of material (e.g., from wood or resin), referred to as the scales, that provide a comfortable grip for the user. Knives typically fall into two categories based on the configuration of the blade with respect to the handle, namely fixed blade knives and folding knives. Fixed blade knives do not fold and generally include a tang extending from the blade into the handle. The tang may be a full tang (extending the full length and width of the handle) or a partial tang (extending only a portion of the length and/or width of the handle). In contrast, folding knives are typically designed so that the blade pivots about a blade pivot located near the hilt, allowing the blade to be secured into the space between the scales.

Knife scales can be made of wood, metal, resin or any suitable composite material. In the case of a fixed blade knife, the scales are placed on the opposite sides of the metal tang and typically fixedly attached thereto with pins, rivets, or glue. In conventional knife making, the two pieces of material for the scales are first secured to the tang and then subsequently shaped into the desired shape of the scales to form the handle. Most commonly, the scales of the knife are attached to the tang with rivets and thus, the scales are not removable. Knives with removable scales have been developed and such knives typically use one or more removable fasteners (e.g., screws) in place of the rivets to affix the scale to the handle. However, knives with removable scales of conventional design may provide sub-optimal performance, e.g., with the handle having too much free play relative to blade as compared to a permanently affixed handle. Thus, designers and users of knives continue to seek improvements, both functional and aesthetic, to the art of knife making.

SUMMARY

Embodiments disclosed herein generally relate to a knife and a scale attachment system for attaching removable scales to a knife.

The present disclosure describes examples of a scale attachment systems for a knife having a blade and a handle defined, at least in part, by a pair of scales removably attached to the blade, the scale attachment system comprising a plurality of U-shaped clips, each of the plurality of U-shaped clips configured to be received in a pair of corresponding grooves on opposite sides of the handle.

In accordance with some embodiments of the present disclosure, a knife having a handle includes a blade having a blade edge and a spine, first and second opposing scales removably coupled to the blade and provided in a spaced apart arrangement such that they are located on opposite sides of the blade, wherein each of the first and second scales includes a plurality of grooves formed on an outwardly-facing side of the scale, and a scale attachment system comprising a plurality of clips, each having a first portion received in a respective groove of the first scale, a second portion received in a respective groove of the second scale, and a connecting portion joining the first and second portions and which extends transversely across the spine side of the handle.

In accordance with further embodiments, a with a handle having at least one removable scale includes a blade having a blade edge and a spine, a tang integrally formed with the blade, the tang having a grip side, a spine side, and opposite first and second tang sides, extending between the grip side and the spine side, a first scale and a second scale, each disposed on and coextensive with at least a portion of the respective one of the first and second tang sides, and a scale attachment system for removably attaching the first and second scales to the tang, the scale attachment system comprising a plurality of clips, each having a first portion received in a respective groove in the first scale, a second portion received in a respective groove in the second scale, and a connecting portion joining the first and second portions, wherein the connecting portion extends transversely across the spine side of the tang, and a plurality of fasteners removably received in respective fastener holes in the clips for removably attaching each of the plurality of clips to the tang thereby removably attaching the respective ones of the first and second scales to the tang.

Example methods for interchanging components of a knife comprising a blade body including a blade, and a handle defined, at least in part, by a pair of scales, may include positioning a first clip of a plurality of clips into first corresponding grooves, each of the grooves on a respective one of the pair of scales, such that the pair of scales are provided in a spaced apart arrangement, positioning a second clip of the plurality of clips into second corresponding grooves of the pair of scales, and securing the handle to the blade by inserting at least one removable fastener through at least one of the pair of scales and the blade body.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments, wherein identical reference numerals refer to identical or similar elements or features in different views or embodiments shown in the drawings.

FIGS. 25-28 show views of the individual clips of a scale attachment system in accordance with examples herein.

DETAILED DESCRIPTION

Examples described herein generally relate to knifes (both of the fixed-blade and folding type) with a unique scale attachment system which allows the user to easily interchange components of the handle, for example the scales or the clips, for functional reasons or to obtain a different aesthetic look. A knife according to some examples herein may include a blade having a blade edge and a spine, first and second opposing scales removably coupled to the blade, and a scale attachment system for removably coupling the scales to the blade. The first and second scales are provided in a spaced apart arrangement such that they are located on opposite sides of the blade, and each of the first and second scales includes a plurality of grooves formed on an outwardly-facing side of the respective scale. The scale attachment system includes a plurality of clips, each having a first portion received in a respective groove of the first scale, a second portion received in a respective groove of the second scale, and a connecting portion joining the first and second portions and which extends transversely across the spine side of the handle. In preferred embodiments, at least a portion of the clips is visible on the outwardly facing sides of the handle over which the clip extends (e.g., the two opposite sides and the spine side) such as to provide a unique look to the handle. In some examples the clips may be configured to position the first and second scales in the spaced apart arrangement, for example by having a particular mating geometry with the scales and/or having features (e.g., a protrusion) that constrain movement of the scales in the desired degrees of freedom. Any suitable number of clips or arrangement thereof may be used in other examples. For example, in some embodiments, the clips may be arranged such that the connecting portion extends across the grip side of the handle.

Figure 1:
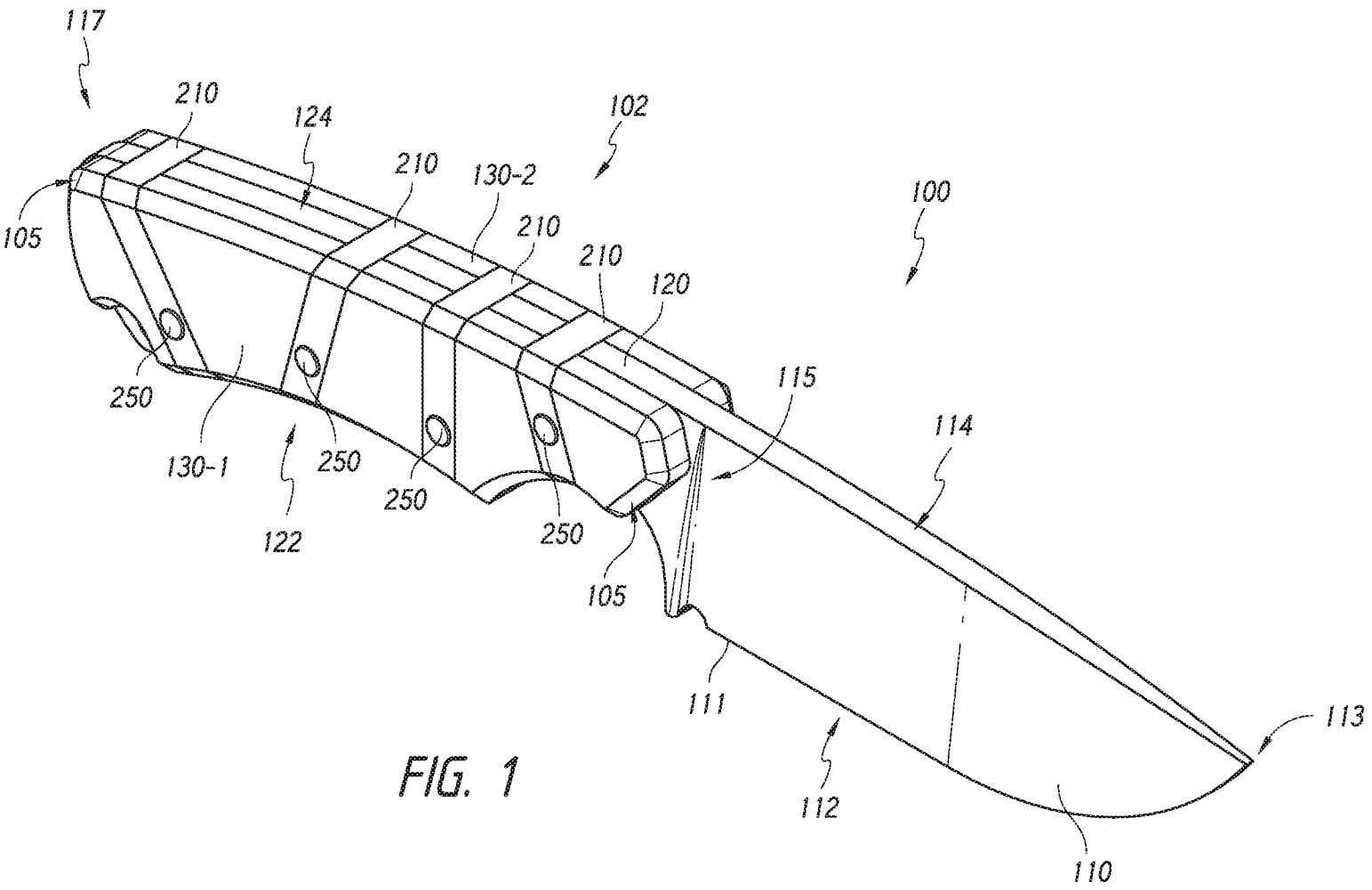
FIG. 1 is an isometric view of a fixed blade knife according to some embodiments of the present disclosure.
Figure 2A:
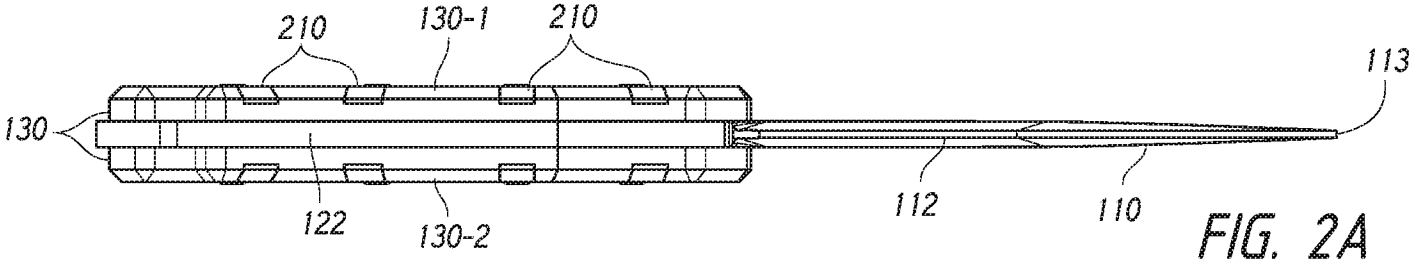
FIGS. 2A-2C are bottom, side, and top views of the knife in FIG. 1.
Figure 2B:
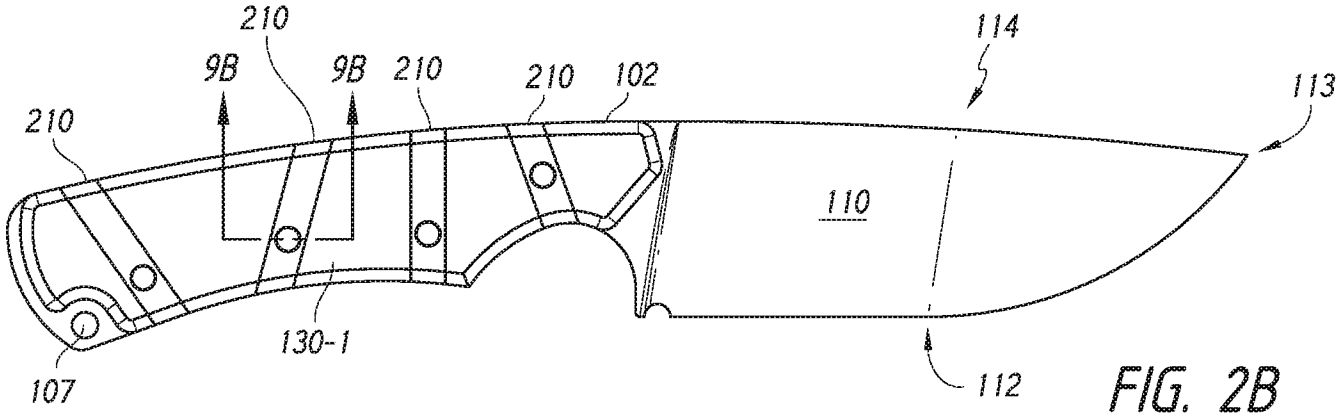
Figure 2C:
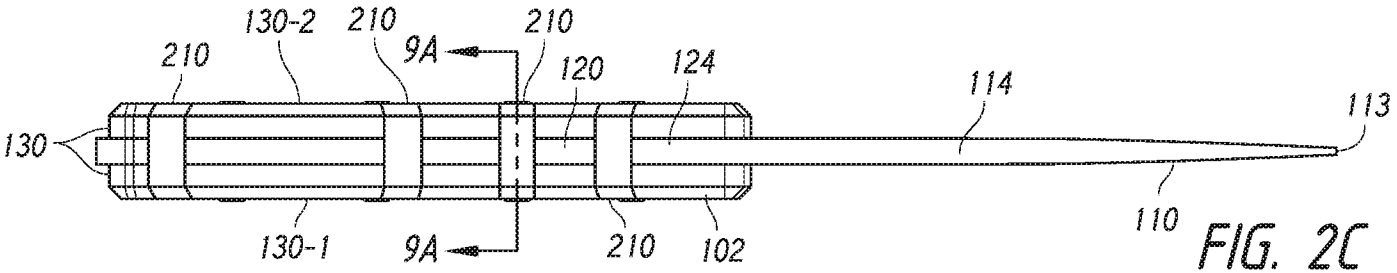
Figure 3:
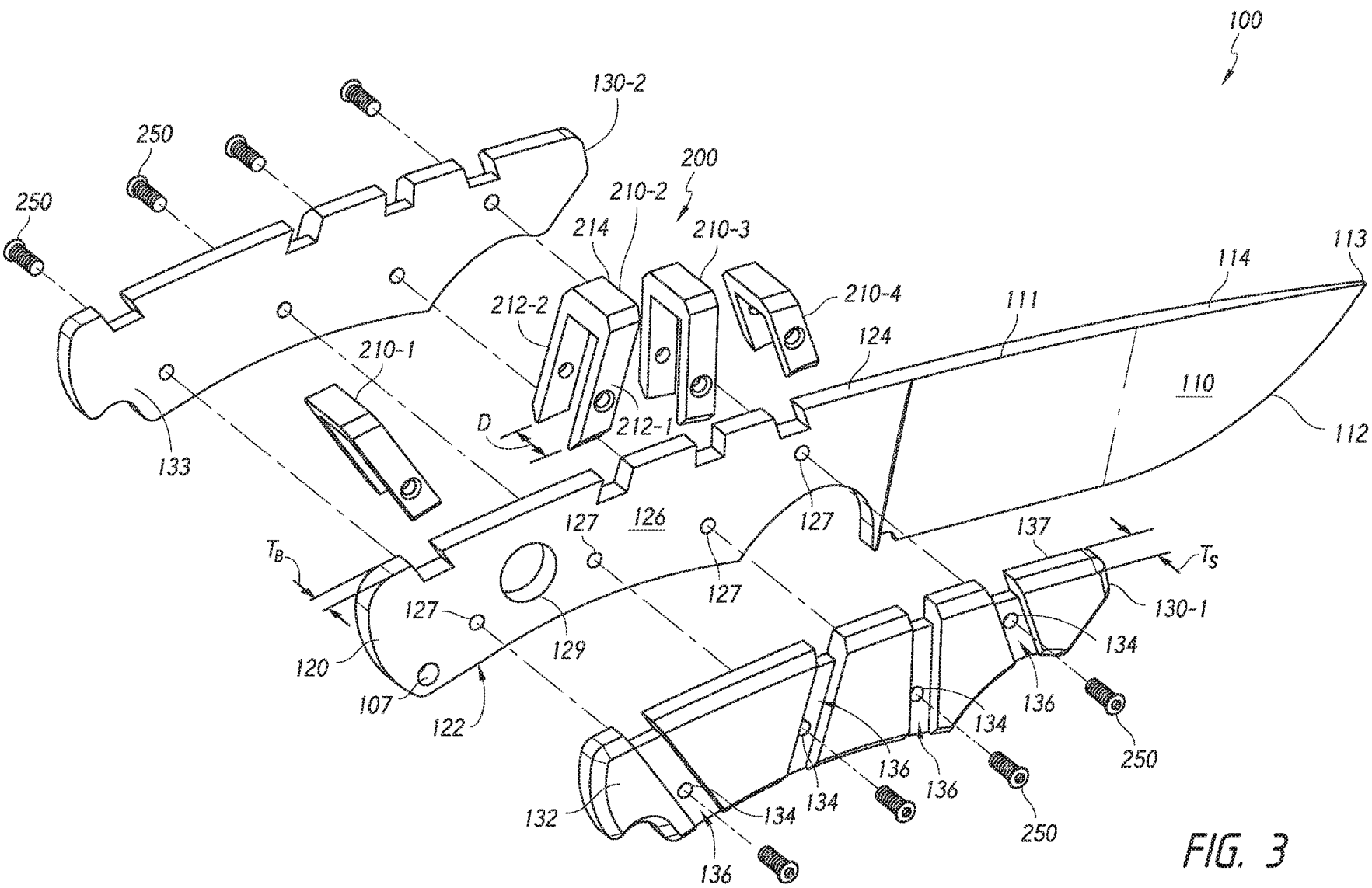
FIG. 3 is an exploded view of the knife in FIG. 1.

Referring now to FIGS. 1-9, a fixed-blade knife 100 according to some embodiments of the present disclosure will be described. The knife 100 includes a blade 110, which has a blade edge 112 and a spine 114. The blade edge 112 and spine 114 meet at the tip 113 and both extend proximally (i.e. towards the user, when the knife is being handled) to the hilt 115. The knife 100 also includes a handle 102, which extends from the hilt 115 of the knife 100, and its proximal end defining the butt 117 of the knife 100. The terms distal and proximal are used herein to refer to components or locations which are away from or near the user, respectively, when the knife is being handled normally (i.e., by its handle). FIG. 1 shows an isometric view of knife 100 and FIG. 3 shows an exploded view of knife 100. FIGS. 2A and 2C show a bottom or grip side view and top or spine side view, respectively, of the knife 100, while FIG. 2B shows a side view of knife 100. FIGS. 4-7 show views of individual separable components of knife 100, including the blade body, which includes the blade and the tang (see FIGS. 4A-4C), the left and right scales (see FIGS. 5 and 6 respectively), and the clip attachment system (see FIGS. 7, and 25 through 28). The components and arrangement thereof in FIGS. 1-9 is exemplary only and variations, such as adding, removing, combining, or rearranging components are all contemplated.

In the case of a fixed-blade knife, as shown in FIG. 1, the knife 100 includes a tang 120, which extends from the blade 110 into the handle 102. Preferably the blade 110 and the tang 120 are integrally formed. That is, the blade 110 and the tang 120 are made from the same piece of material (typically metal, however ceramic and other suitable materials may be used for the blade and/or tang), such as by casting, molding, and/or machining stock material into the desired shape of the blade body. In the illustrated example, and as more easily seen in FIGS. 3 and 4, the tang 120 of the knife 100 is a full tang, meaning that it substantially extends the full length of the handle and substantially spans the full width of the handle. However, in other examples, the tang may be a partial tang and may extend only partially the length of the handle and/or span only partially between the spine side and the grip side of the handle. A knife with a full tang, and one which is integrally formed with the blade, generally offers superior performance as compared to other knives, for example those having partial tangs. However, it will be understood that the scope of the present invention is not limited to a knife having a full tang and/or integrally formed tang and blade as illustrated in FIG. 1.

To achieve a well-balanced knife, in some examples, a full tang may be at least partially skeletonized, which implies that at least a portion of the material within the perimeter of the tang is removed. Generally a full tang may provide superior strength of handle but may result in an unbalanced knife, as the weight of the material in the handle may be greater than the weight of the blade. As shown in FIGS. 3 and 4, a weight-balance feature 129, in this case a weight-balancing aperture, which is a through-thickness aperture may extend through the thickness $T_B$ of the tang 120 from the first tang side 126 to the second tang side 128, may be provided in a portion of the tang which is otherwise concealed by the scales. In other examples, the weight-balancing feature(s) may include differently shaped through-thickness apertures, or other material subtractive features such as surface grooves formed on one or both of the sides 126, 128, and which do not extend fully through the thickness $T_B$. Any combination of weight-balance features 129 that facilitate a more even distribution of the weight between the blade 110 and handle 102 may be used.

The handle 102 of knife 100 is formed, at least in part, by a pair of opposing scales 130 (i.e., first scale 130-1 and second scale 130-2). The scales 130-1 and 130-2 are arranged such that they are spaced apart from one another. In the fixed-blade example in FIG. 1, the scales 130-1 and 130-2 are disposed on opposite sides of the tang 120. In this example, each scale 130 abuts one of the two major sides of the tang (i.e., tang sides 126 and 128) and the scales 130 are, thus, spaced apart by a distance equal to the thickness T of the tang 120. In other examples, one or more additional layers may be provided between the scales 130 and the tang 120, for example for adjusting the balance of the knife. In yet further examples, such as in the case of a folding knife, the scales may be provided in a spaced apart arrangement with a gap remaining therebetween to define a cavity into which the blade of the folding knife is receivable, e.g., as will be described further below with reference to FIG. 19.

In some examples, as shown in FIGS. 1-9, each scale 130 may be substantially co-extensive with a major side of the tang 120, that is, with tang side 126 or tang side 128. By substantially co-extensive, it is generally meant, that the shape of the scale substantially matches the shape of the tang such that the scale extends substantially over the entire surface of the tang (e.g., from the top or spine side 124 to the bottom or grip side 122 of the tang 120, and from hilt to butt). As shown in FIG. 1, the top sides of the scales are shaped such that they fit flush with the top side of the tang forming a smooth top surface of the handle, and similarly, the bottom sides of the scales are shaped to be flush with the bottom side of the tang to form a substantially smooth or flush surface across the grip side of the handle. A portion of the tang at the butt end of the handle is exposed thereby exposing a lanyard aperture 107, although in other examples, the scales may extend to also cover this portion of the tang and may define lanyard apertures (not shown) there through which align with the lanyard aperture 107 in the tang. In other examples, the scales need not be substantially co-extensive with the tang. In some such examples, the scales may be co-extensive with only a portion of each tang side, and thus be referred to a partial scales. In some such examples, the scales may cover only a portion (e.g., up to 50%, or up to 75%, in some case between 25 and 50% of the surface of the tang side), such as for example a portion near the hilt of the knife. In yet further examples, a scale on a given side may be provided as the combination of a plurality of partial scales which may be arranged (in a contiguous or non-contiguous manner) along the given side of the tang. In some examples, as shown in FIGS. 1-3, the peripheral edge 105, or a portion thereof, of the outward facing side of each scale 130 may be beveled for a more comfortable grip and/or improved aesthetics.

The scales 130 are attached to one another and the blade body 111 to form the handle 102 of the knife 100. In accordance with the principles of the present invention, the scales 130 may be attached via a unique scale attachment system, which may provide functional and/or aesthetic improvement(s) over the state of the art. In the example in FIG. 1, the scale attachment system 200 removably joins the scales 130-1 and 130-2 to the tang 120, which together form the handle 102 of knife 100. The scale attachment system 200 includes a plurality of clips 210 configured to interlock with the scales 130 and the tang 120, and may thus be interchangeably referred to as a clip locking system (CLS) or simply clip system. In the example in FIG. 1, the scale attachment system 200 includes four clips 210, however it will be appreciated that in other examples, a different number of clips, for example, 2, 3 (as in the example in FIG. 19), or greater number than 4 may be used without departing from the scope of the present invention. In other examples, a scale attachment system according to the present disclosure may be used to attach the scales of a folding knife to one another and to the blade, while still facilitating a quick interchange of components, as will be described further with reference to FIG. 19.

The scales 130 can be made of wood, metal, resin or any suitable composite material. In the case of a fixed blade knife, the scales 130 are placed on the opposite sides of the metal tang and typically fixedly attached thereto with pins, rivets, or glue. In conventional knife making, the two pieces of material for the scales are first secured to the tang and then subsequently shaped into the desired shape of the scales to form the handle. Most commonly, the scales of the knife are attached to the tang with rivets and thus, the scales are not removable. Knives with removable scales have been developed and such knives typically use one or more removable fasteners (e.g., screws) in place of the rivets to affix the scale to the handle. However, designers and users of knives continue to seek improvements, both functional and aesthetic, to the art of knife making.

Referring back to FIG. 3, the individual clips 210 have a generally U-shaped clip body defined by first and second substantially parallel leg portions 212-1 and 212-2, respectively, and a connecting portion 214 (also referred to as upper portion in this example, as the clips are configured to extend transversely across the upper or spine side of the knife) extending between and joining the two portions 212-1 and 212-2. The first and second portions of a clip are thus spaced apart by the connecting portion 214 (by a distance D) and are configured to be positioned on opposite sides of the tang in the assembled configuration. The first and second portions 212-1 and 212-2 define a channel 216 which accommodates the insertion of handle components therein, e.g., through the opening 218 defined between the free ends of the first and second portions 212-1 and 212-2. The channel 216 is wider than the thickness T of the tang 120 but narrower than the combined thickness of the tang 120 and scales 130-1 and 130-2. The scales include corresponding grooves 136 on their outward-facing sides 132 which grooves are sized to accommodate respective ones of the first and second portions 212-1, 212-2. For example, in this embodiment, and referring now also to FIGS. 5-7, the scale attachment system 200 includes four clips 210-1, 210-2, 210-3, and 210-4, and the scales 130-1 and 130-2 correspondingly include four grooves 136-1, 136-2, 136-3, and 136-4 configured to accommodate the parallel portions of the respective ones of the clips. The right and left scales are mirror image of each other. In some examples, and depending upon the design and overall shape of the handle and/or scales, the portions 212-1 and 212-2 may not be parallel to one another but may taper, for example away from one another, from the connection portion 214 to their free ends. Regardless, in preferred examples, the clips 210 are designed such that when assembled, a portion of the clip wraps around at least one of the spine side or the grip side. In some cases, opposing U-shaped clips, one wrapping the spine side and one wrapping the grip side may be used to give the look of a feature wrapping fully around the transverse perimeter. In some embodiments, the U-shaped clips may be provided as two separate halves, e.g., meeting at the spin side of the handle. However, as will be appreciated, in preferred embodiments, a continuous strip of material may be used for each clip, which can offer superior strength and rigidity of the assembled handle, e.g., by virtue of the clips providing a three-sided mechanical interlocking component to minimize or eliminate movement (or free play) of the scales with respect to the blade when assembled thereto.

When assembled, the first portion 212-1 of each of the clips 210 is received in a respective groove 136 on the first (or tight) scale 130-1 and the second portion 212-2 of each of the clips 210 is received in a respective groove on the second (or left) scale 130-2. The connecting portion 214 of each clip extends transversely across the spine side of the handle 102. Thus, when assembled, the clips 210 wrap at least partially around the handle, in this case extend transversely (perpendicularly or at an angle to the lengthwise direction) along at least a portion of at least three sides of the handle. As such, the scale attachment system 200 of the present disclosure presents a unique look of the handle 102 appearing as being wrapped, at least partially, around its transverse perimeter. Also, as illustrated, when assembled, each of the scales 130 abuts the connecting portion 214 of one or all of the clips 210, which are also nested within slots 125 in the blade body 111, this arranging providing a more tightly fitting blade to handle assembly (e.g., substantially eliminating free play between the components). In a conventional knife where the scales are typically attached to the blade by two or more rivets, the loosening of the rivets can result in undesirable free play between the scales and blade. In contrast, each individual clip and also the interlocking of components (e.g., the clip(s), scales, and tang) according to the present disclosure, constrains the movement of the scales relative to the tang along multiple degrees of freedom, with the constraining force being applied over a larger surface area (e.g., as compared to a two-point or two-fastener connection system of a conventional knife), which functions to reduce free play even if one or more of the fasteners become loose. Thus, the scale attachment system 200 may provide a number of functional and aesthetic benefits, such as the unique look, the ability to easily interchange the scales and/or components of the scale attachment system 200 (e.g., the individual clips may be interchanges with clips of different material and/or color), and a superior (e.g., in terms of rigidity and strength) attachment of the scales to the blade body as compared to the state of the art.

Figure 4C:
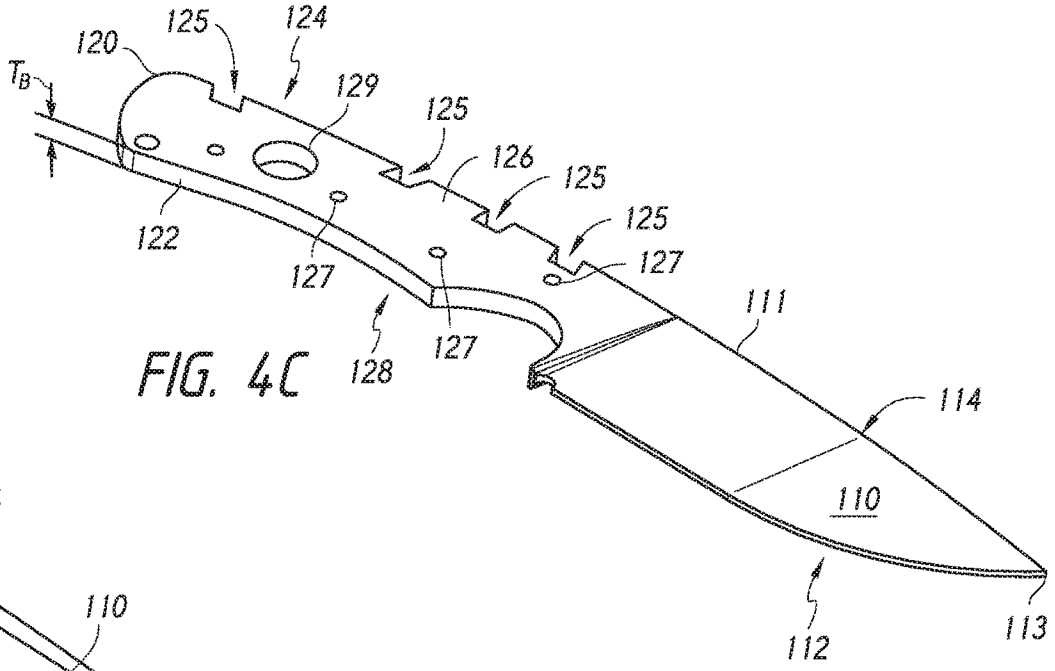
FIGS. 4A-4C are views of the blade body of the knife in FIG. 1.
Figure 4B:
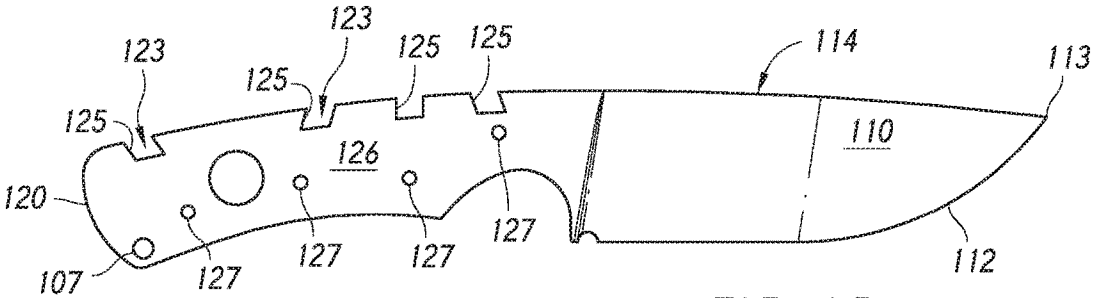
Figure 4A:
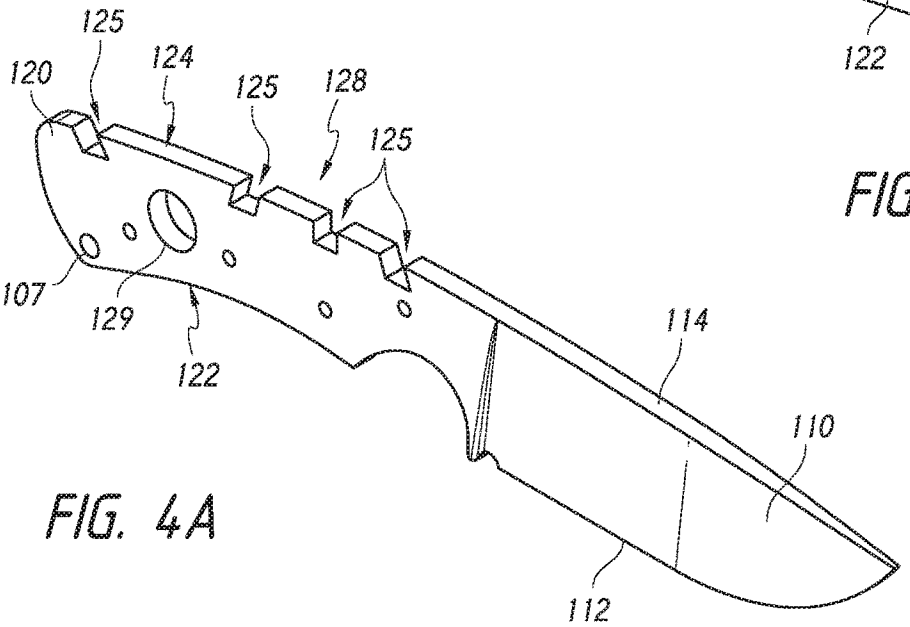

FIGS. 4A-4C show the blade body 111 of knife 100. The blade body 111 includes the blade 110 and the tang 120, which may be integrally formed from a unitary piece of material, such as stainless steel, titanium or other suitable metal. The blade body 111 may be machined from a block of stock metal or it may be cast into the general shape of the blade body and then machined to more precise dimension tolerances. As described herein, the tang 120 may be configured for the attachment of scales thereto, and specifically for attaching the scales 130 using the unique scale attachment system of the present invention. To that end, the tang 120 may be configured for a cooperating fit with the clips 210 of scale attachment system 200. The tang 120 may also include fastener holes 127 for receiving fasteners 230 used for attaching the clips 210 to the tang 120, which thereby secures the scales 130 to the tang 120 to form the handle 102.

As described, the clips 210 are recessed into the handle 102 such that they are flush with the adjoining surfaces of the handle 102. To accommodate the clips 210 in this recessed arrangement, the tang 120 includes slots 125 disposed about at least a portion of the perimeter of the tang. Each of the slots 125 is configured for a cooperating fit with its respective clip. Each of the slots is defined by a base offset inwardly (i.e., toward the centerline of the tang) from the nominal contour 201 of the spine of the handle 102 and opposing sidewalls connecting the base to the spine side 124 of the tang. Each of the slots 125 is configured to allow the corresponding clip 210, and specifically the connecting portion 214 of the clip, to be received substantially fully into the slot 125 such that the upper surface of the clip is flush with the adjoining surfaces of the handle 102, which may offer a more aesthetically pleasing look and/or a more comfortable grip for the user. Thus, each slot 125 has a cross section 123 (see e.g., FIG. 4B) which substantially matches the cross section 213 of the upper portion of the corresponding clip (see e.g., FIGS. 25 through 28). As shown in FIG. 4B, in some examples, the slots 125 may have a constant width from their opening to the base. In other examples, the width of one or more of the slots 125 may vary with depth, for example the width may decrease from the opening toward the base.

In the example in FIG. 1, the scale attachment system 200 is configured such that the clips 210 are angled to one another when assembled to the handle 102. Thus, correspondingly, the slots 125 extend in non-perpendicular directions to the spine side 124, with the slots' centerlines 211 being angled to one another. The angle between adjacent slots may vary in different embodiments, for example, the angle may be up to about 10 degrees, up to about 15 degrees, up to about 20 degrees, or up about 50 degrees. In some cases, the slots may be arranged at angles to one another exceeding 50 degrees. In this example, the slots 125 are non-evenly spaced and each extends to the same depth (and correspondingly each clip has a connecting portion 214 of the same thickness). It will be understood, however, that the slots 125 may have different configuration (e.g., different spacing, angular orientation, depth and/or width) in other embodiments. For example, in some embodiments, the clips 210 may be arranged such that they are substantially parallel to one another and/or substantially equally spaced apart. In some embodiments, the clips and their corresponding slots may be arranged such that they extend substantially perpendicularly to the nominal contour line 201, which in the illustrated example is curved, thus the clips and slots may be arranged in a radial pattern. Depending on the arrangement of the clips, differently positioned and/or shaped weight-balancing features than illustrated may be used, for example, an elongate slot instead of a circle may be used if the clips and thus slots are move evenly distributed over the length of the tang. Any suitable variation for securing holding the scales to the blade body 111 may be used in other embodiments.

In the example in FIG. 1, each clip 210 is retained to the tang 120 via a pair of opposing fasteners 250. The fasteners in each pair are aligned such that each pair of opposing fasteners 250 is received in the same fastener hole 127 of the tang 120. In other embodiments, the fasteners may be offset from one another and be received in different holes, which may in some examples be centered along the centerline 211. In yet further examples, a single fastener may be used to secure both sides of the clip to the tang. In yet further examples, a single clip may be secured to the tang using multiple (e.g., 2, 3 or more) fasteners on each side. As described, the clips 210 are secured to the tang removably, e.g., with a threaded fastener such that they can be removed and/or replaced. In some examples, the aesthetic look of the knife may be changes by replacing the clips or the fasteners only (without replacing the scales), for example by using a clip of a given type of metal or with a particular type of treatment or coating (e.g., anodized aluminum or titanium) and a fastener of a different type of metal or treatment (e.g. non-anodized aluminum or a stainless steel) which can provide contrasting look between the two materials, coatings or treatments.

Figure 5A:
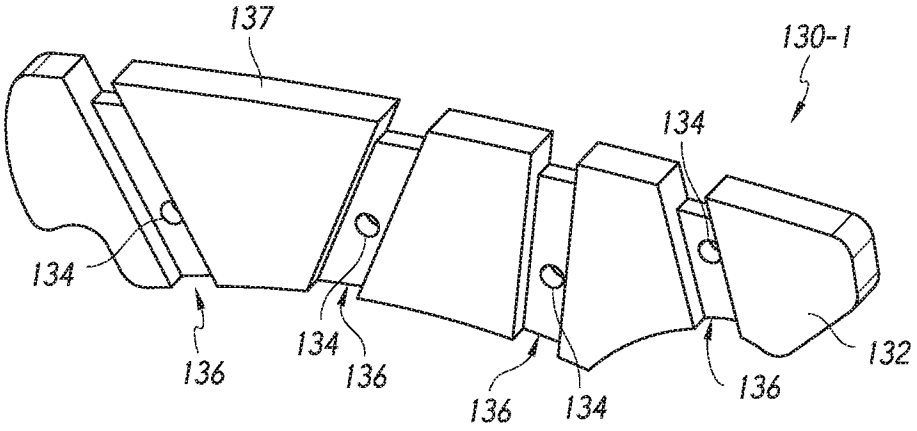
FIGS. 5A-5C are views of a first (e.g., right side) scale of the knife in FIG. 1
Figure 5B:
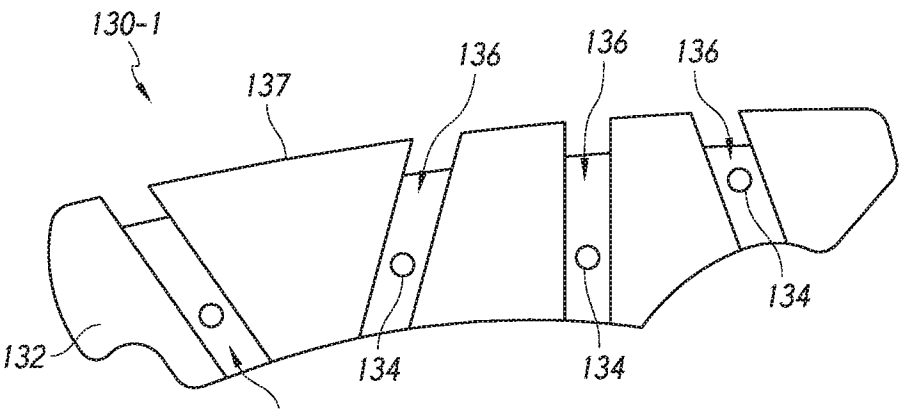
Figure 5C:
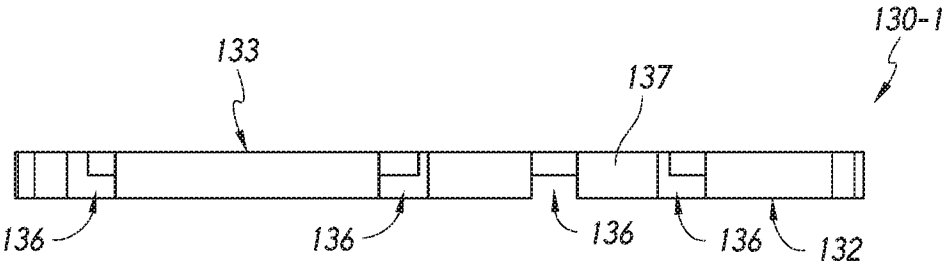
Figure 6A:
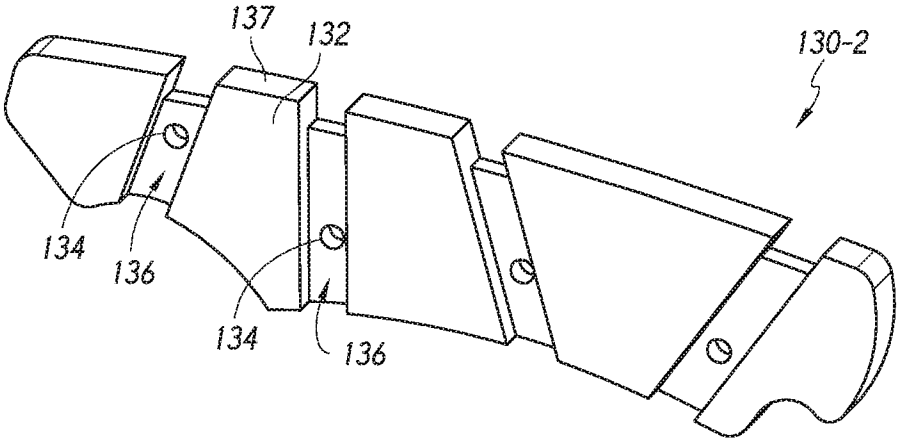
FIGS. 6A and 6B are views of a second (e.g., left side) scale of the knife in FIG. 1.
Figure 6B:
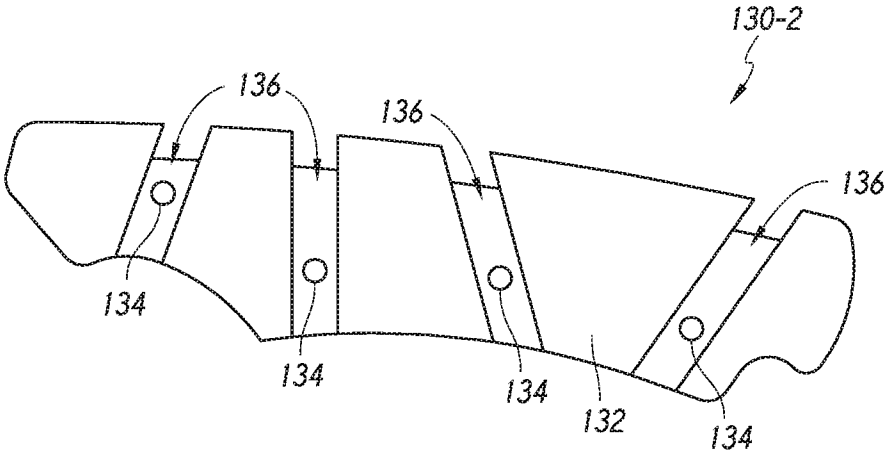

FIGS. 5A-5C show views of the right scale 130-1 and FIGS. 6A and 6B show views of the left scale 130-2, before beveling of the perimeter edges. Each of the scales 130-1 and 130-2 has a number of grooves 136 configured to accommodate a corresponding number of clips 210. Each of the grooves 136 in the illustrated example are generally rectangular in cross section. In other examples, other suitable geometries may be used, for example dovetail geometry (as in the example in FIG. 19), rounded (or half circle) geometry, triangular geometry (e.g., with the tip pointing toward the inwardly-facing side, etc. Each groove 136 includes a first or side groove portion, which extend along the outward-facing side 132, in this case from the bottom or grip side to the top or spine side of the scale although in other examples the groove need not extend all the way to the bottom. The groove 136 further includes a second or upper groove portion defined by a recess open at the top surface 137 and having a depth equal to that of the corresponding slot 135 on the blade body such that when the scales are assembled to the handle, the upper groove portions align with and match the shape of the corresponding slot 135, to accommodate the insertion of the clip therein and the forming of a flush smooth surface along the spine side of the knife. Each of the scales also includes a corresponding number of fastener holes, in this case a single fastener hole per groove, which is formed in the recessed portion of the scale defined by the groove. In this example, the fastener holes 134 are not threaded. However, in other examples (e.g., in FIG. 19), the fastener holes may be threaded for securing the fasteners to the scales.

Figure 7:
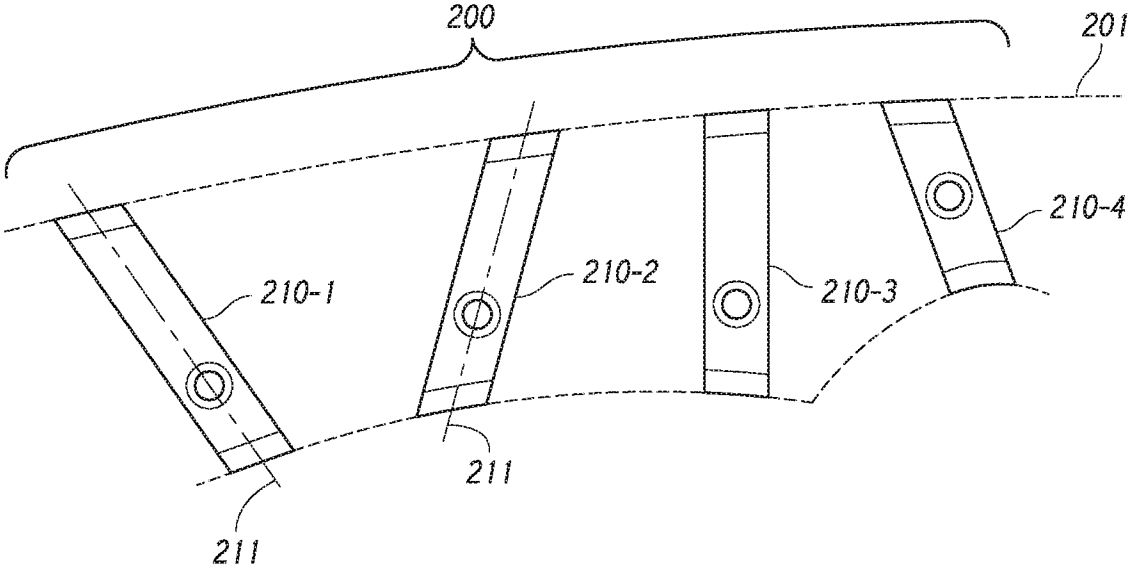
FIG. 7 shows an arrangement of clips of the scale attachment system of the knife in FIG. 1.

FIG. 7 shows an arrangement of clips of the scale attachment system 200 and FIGS. 25 through 28 show the individual clips of FIG. 7. As previously described, at least some of the clips in this embodiment are arranged so that they are angled rather than normal to the spine of the handle (e.g., contour line 201). Thus the centerline(s) 211 of one or more of the clip is at an angle other than 90 degrees to the line 201. Also, the clips, when assembled to the handle, may be angled to one another (i.e., non-parallel), thus the centerline 211 of one or more of the clips may be at an angle to the centerline of another one of the clips (e.g., those of the two adjacent clips 210-1 and 210-2). The clips of a given scale attachment system for a given knife may also vary in length. In the illustrated example, the clip 210-4 closest to the hilt 115 is shortest than any of the other clips. The clip 210-1 closest to the butt of the knife may be longer than the other clips, in part because of the greater amount of incline with respect to the spine. As shown in FIGS. 25 through 28, each of the clips 210-1 through 210-4 includes two opposing substantially parallel legs 212-1 and 212-2 joined by a connecting portion 214. As described the clips are each configured for a cooperating fit within the corresponding slot 125 in the tang and the upper groove portion of the grooves 136 in the scales. Thus, as shown, the transverse cross section of the top portion of each clip matches the cross section of the corresponding slot in the tang. In some examples, for ease of manufacturability, each of the clips may be of substantially the same geometry such that the clips are interchangeable or fungible; however, clips of different geometries and configured different alignment with respect to one another may provide a unique aesthetic look. The alignment of the clips with respect to each other and the handle may be selected to more firmly constrain movement in specific locations of the handle in a desired direction.

In the illustrated example, the fastener holes 217 of the clips are neither aligned nor centered along the length of the clips. In some examples, the fastener holes 217 may be provided closer to the grip side of the handle, e.g., to reduce free play or gapping at the free ends of the clips. In other examples, the fastener holes may be differently arranged (e.g., they may be centered along the width of the handle and/or aligned with the fastener holes of other clips). In some examples, more than one fastener per side may be used to secure each clip which may provide not only a stronger connection but also a different aesthetic to the handle. In this example, the fastener holes are countersunk to accommodate the head of the fastener therein, which again can provide a pleasing aesthetic and a comfortable fit of the handle 102 within the user's hand. However in other examples, a different type or arrangement of fasteners and holes may be used. In the illustrated example, the clips extend from the top side to the bottom side of the handle, thus the top side of each clip matches the spine side of the handle, while the bottom contour of each clip matches the contour of the grip side of the handle. The clips are also beveled to match the beveled peripheral edge of the scales, again providing a handle with a more comfortable fit for the user. In other examples, the clips may only extend partially down towards the grip side. As described, each clip may be formed from a unitary piece of material, for example all four clips may be machined from a block of metal. In some embodiments, each of the clips in a set may have substantially the same geometry thus, the individual clips may be fungible. A knife kit may be provided, which may include one blade, one or multiple sets of scales, and multiples sets of clips and/or fasteners, which can be made from different materials and or have different coatings or color. This can allow for interchangeability of components, e.g., the clips and/or fasteners, to provide a different feel and/or look to the knife. In some cases, the knife kit may include multiple sets of scales, each set including a pair of the right and left side scales, and the scales in each set may be of different colors and/or materials (e.g., wood, metal, resin, composite, ceramic, etc.), again allowing the user to change the look or functionality (e.g., one handle may be less porous or more textured and thus more suitable for certain applications than another) of the knife as desired.

Figure 8A:
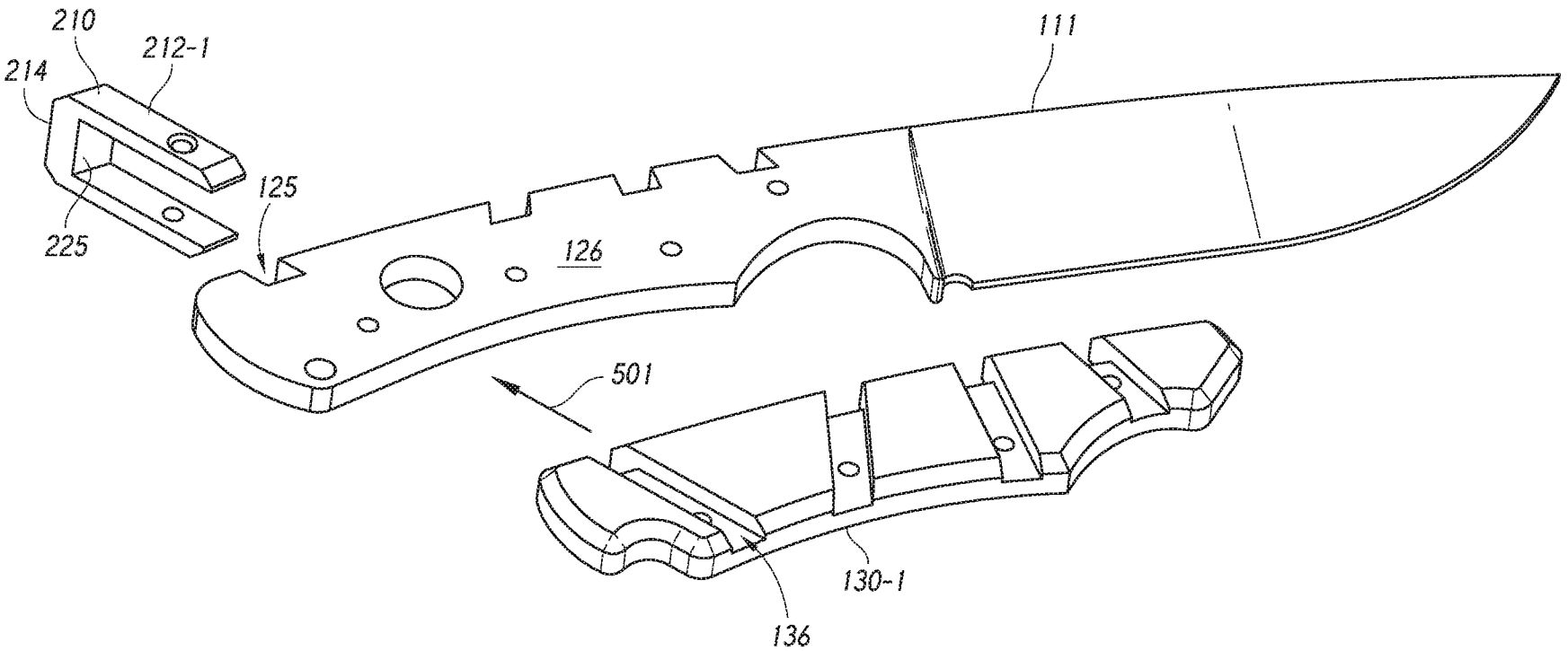
FIGS. 8A-8C show a sequence for assembling the knife in FIG. 1 in accordance with some examples of the present disclosure.
Figure 8B:
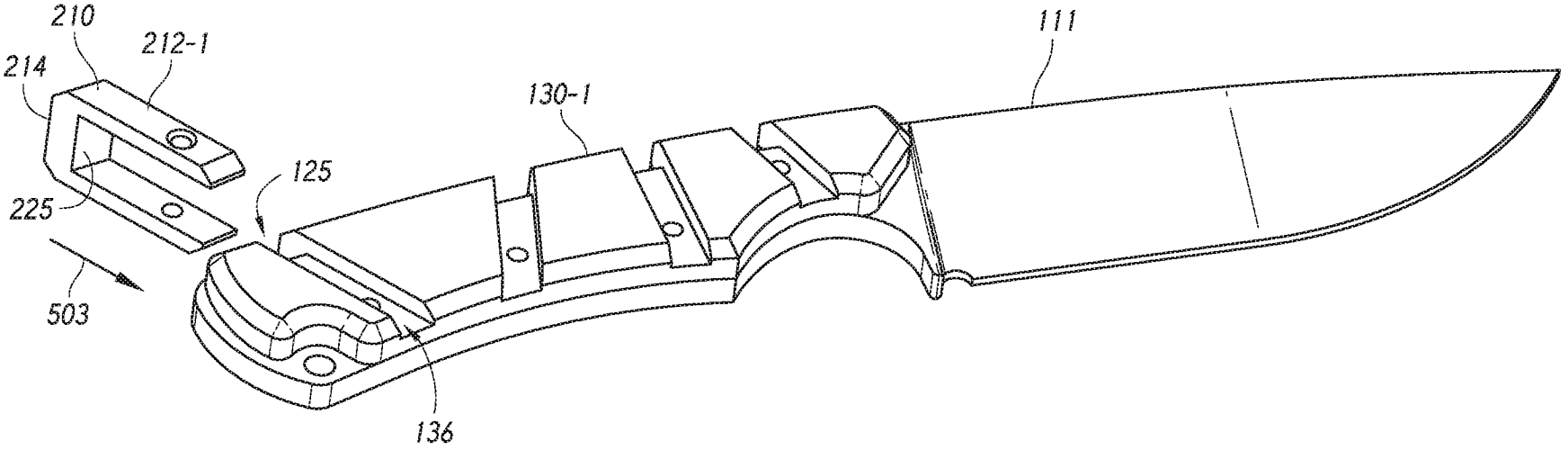
Figure 8C:
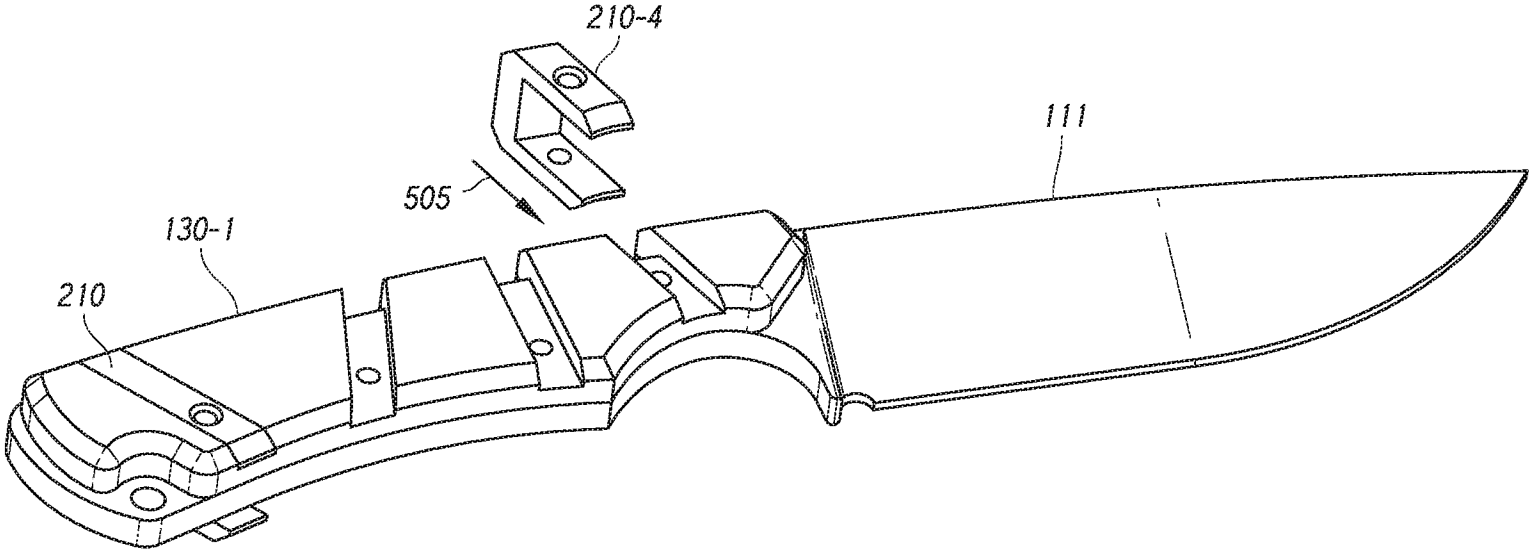

Different sequences of assembling the knife may be used. As previously described, the user may hold the scales 130-1 and 130-2, with the upper grooves and fastener holes aligned to the slots and fastener groves in the tang and then slide the clips over the two scales thereby sandwiching the tang in between the scales. The user may then fasten each clip to the tang by inserting a fastener into each fastener hole 217, the fasteners 250 passing through the fastener holes 134 and terminating at the fastener holes 127 in the tang, which thereby secures each of the scales to the tang. Alternatively, the user may position one of the scales (e.g., scale 130-1) on the appropriate side of the tang (e.g., 126) as shown in FIG. 9A. The user may then position one of the clips 210 in engagement with the blade body 111 and the first scale 130-1, such as by moving the clip 210 along the direction 503, which is a direction in which the leg portion 212-1 is generally aligned with the length of the groove 136. In this manner, the clip 210 may be slid into position with respect to the blade body and scale until the inwardly facing side 225 of the upper portion 214 abuts the base of the upper groove in the scale and the base of the corresponding slot 125 in the tang, e.g., as shown in FIG. 8C. The user may then secure the first or right side of the clip to the handle with a fastener and may then proceed to insert the other clips, e.g., by inserting the clip 210-4 similarly by sliding it into the corresponding groove along a direction 505 which aligns the clip leg portion to the length of the groove 136, or by inserting any of the other clips, in any desired sequence. The user may then position the opposite leg portions of the clips in engagement with the left side scale, e.g., by sliding the scale between the space defined by the clips and Chang on the opposite side of the tang. Alternatively, the user may, after inserting and/or securing the first side of the first clip to the handle, position the other scale into place and secure the opposite side of the first clip to the second scale before proceeding to assemble the remaining clips. In yet another example, the user may position the clip 210 into place with respect to the blade body and then insert each of the scales 130-1 and 130-2 by sliding each of the scales in a direction 501 in which the groove(s) 136 are aligned to the length of the leg portion(s) 212 of any of the clips already in position.

Figure 18A:
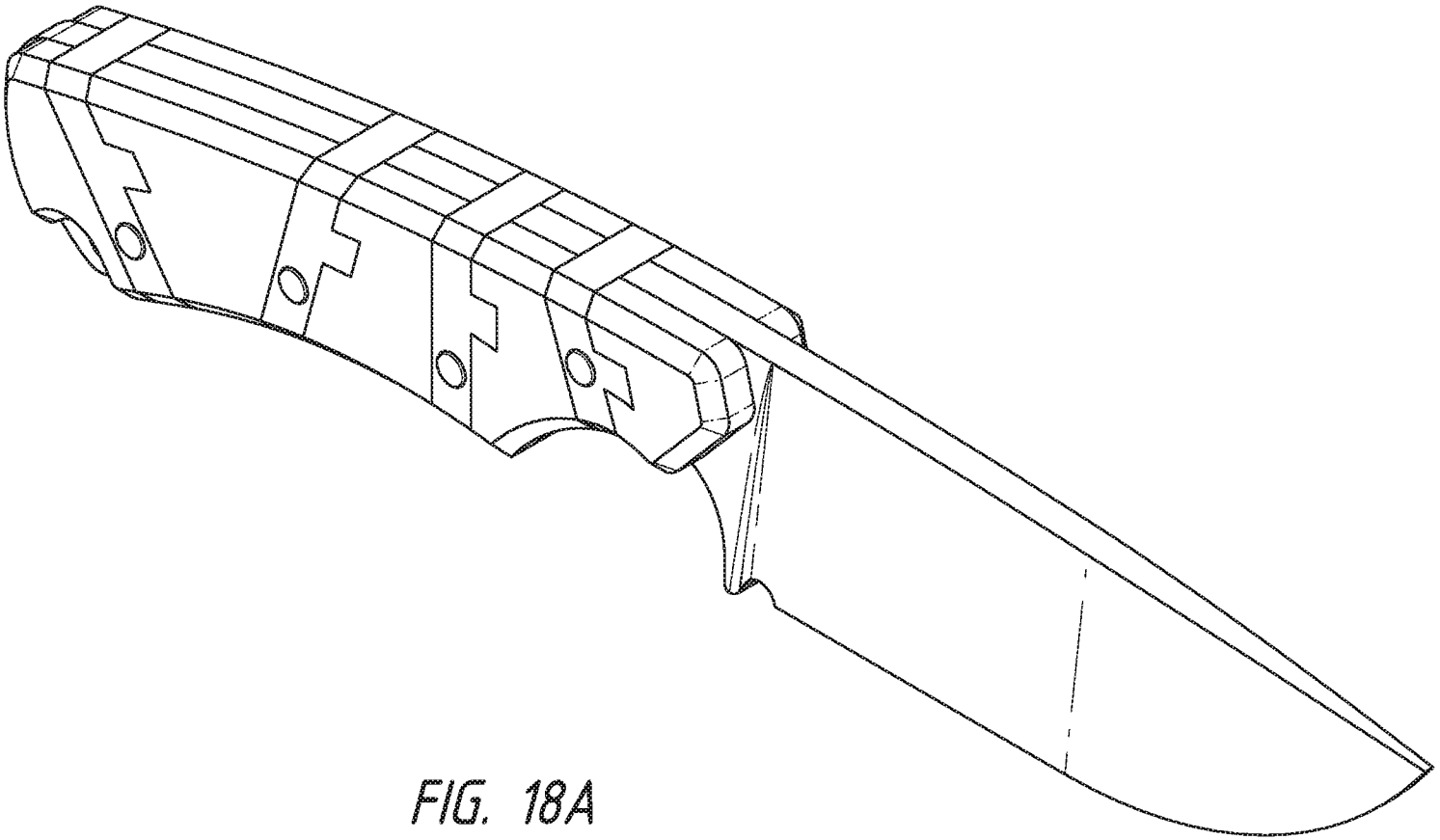
Figure 18B:
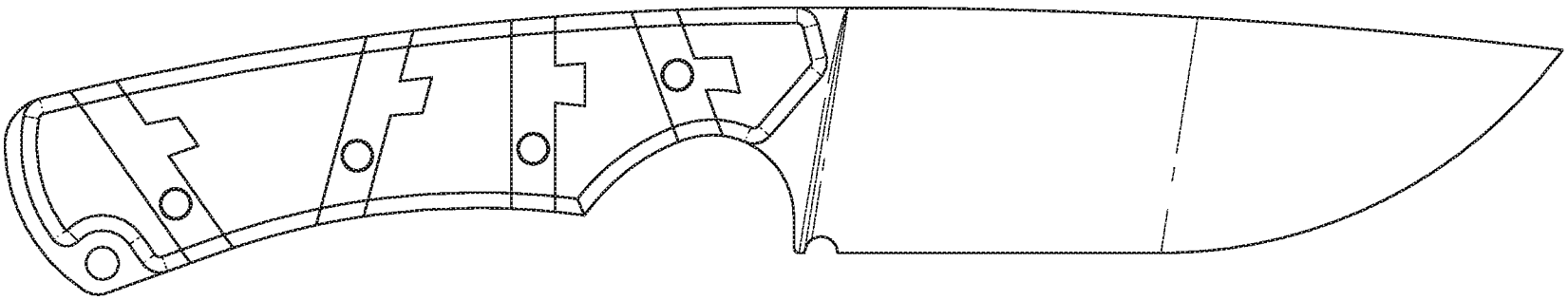

Any number of alternative assembly sequences may be used. For example, in the case of the folding knife in FIG. 19, the user can fix each scale to the blade body first by inserting and securing one or more of the fasteners, e.g., the fastener at the blade pivot, and then proceed to insert the clips into position with respect to the grooves in the scales. In another example, in which the clips constrain transverse movement of the scale (e.g., movement in a direction perpendicular to the lengthwise direction), the user may position the clips into the grooves of the scales thereby positioning the scales into a spaced apart arrangement which is maintained so by the clips and/or grooves geometry. The user may then slide the blade between the two scales and secure the blade to the knife with one or more fasteners (e.g., a fastener at the pivot in the case of a folding knife or one or more fasteners through one or more of the clips. In yet a further alternative sequence, each of the scales may first be placed into engagement with the clips and the tang may then be slid between the two scales until the slots on the spine side of the tang nest with the clips. This latter sequence may be particularly useful for assembling a handle with irregularly shaped clips, e.g., as shown in FIGS. 18A and 18B, the shape of which may not otherwise enable insertion of the clips from the top side. In this scenario, each scale is, in sequence, placed into the channel(s) defined between the two leg portions of one or more of the clip and then moved transversely (up or down) such that the leg portion(s) of the clips are positioned into the groove(s) of the scale. The user may then optionally insert fasteners to hold the clips to scales, or the user may slide the tang between the two spaced apart scales and then insert the fasteners into the corresponding fastener holes and secure the blade body to the handle.

Figure 9B:
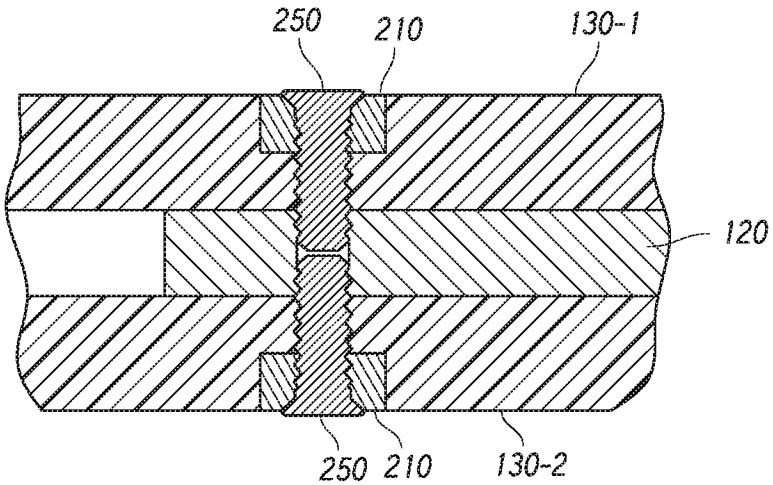
FIG. 9B shows a partial cross-sectional view of the knife in FIG. 1 taken along the line 9B-9B in FIG. 2B.
Figure 9A:
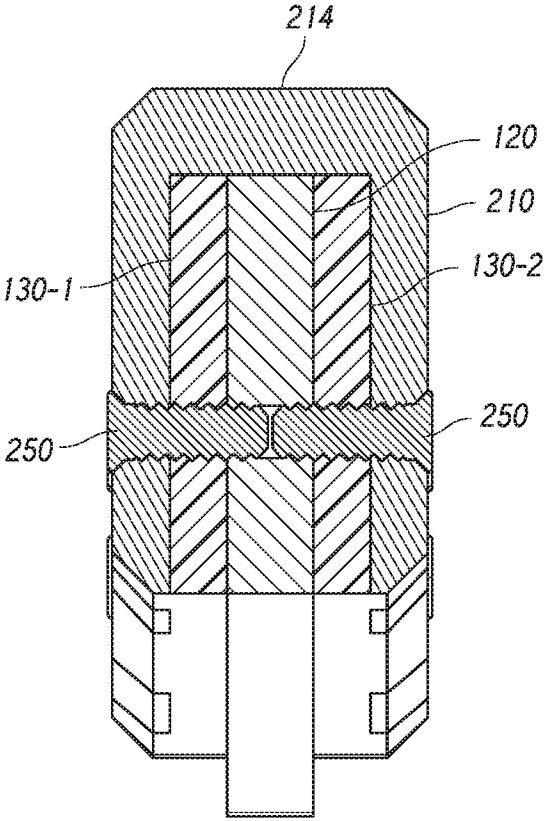
FIG. 9A shows a cross-sectional view of the knife in FIG. 1 taken along the line 9A-9A in FIG. 2C.

FIG. 9A shows a transverse cross-sectional view of the knife 100 taken at line 9A-9A in FIG. 2C and FIG. 9B shows a partial cross-sectional view taken of the knife 100 taken at line 9B-9B in FIG. 2B, showing the internal arrangement of components. For example, as shown in FIG. 9A, the clip 210, which is configured to sit into the groove in the outwardly-facing sides of the scales 130-1 and 130-2 wraps around three sides (i.e., extends along the tight and left sides and transversely across the top side) of the handle. In the example in FIG. 9A, the inwardly-facing sides of the scales 130-1 and 130-2 are against (i.e., abut) the first and second tang sides, respectively, of tang 120, and the upper portion 214 of the clip 210 is against the base of the upper grooves of the scales and the slot in the spine side of the tang 120. Also as shown in FIGS. 9A and 9B, two fasteners 250 are used to secure the clip 210, the leg portions of which have a rectangular cross section, to the tang 120, thereby securing the scales to the tang by sandwiching them between the clips and tang. As described, the fasteners 250 may terminate in threaded fastener holes in the tang and in some examples the fastener holes in the clips and/or the scales need not be threaded. As shown, the fastener holes in the clips are countersunk so that the fasteners sit flush with or below the outer surface of the handle for a more comfortable fit in the user's hand. As also shown, the fasteners 250 in this example are co-axially aligned (i.e. the centerlines of the fasteners lie along the same axis. In other examples the fasteners may not be co-axially aligned, but may instead be offset along one or two directions and may thus provide a different aesthetic look.

Figure 10:
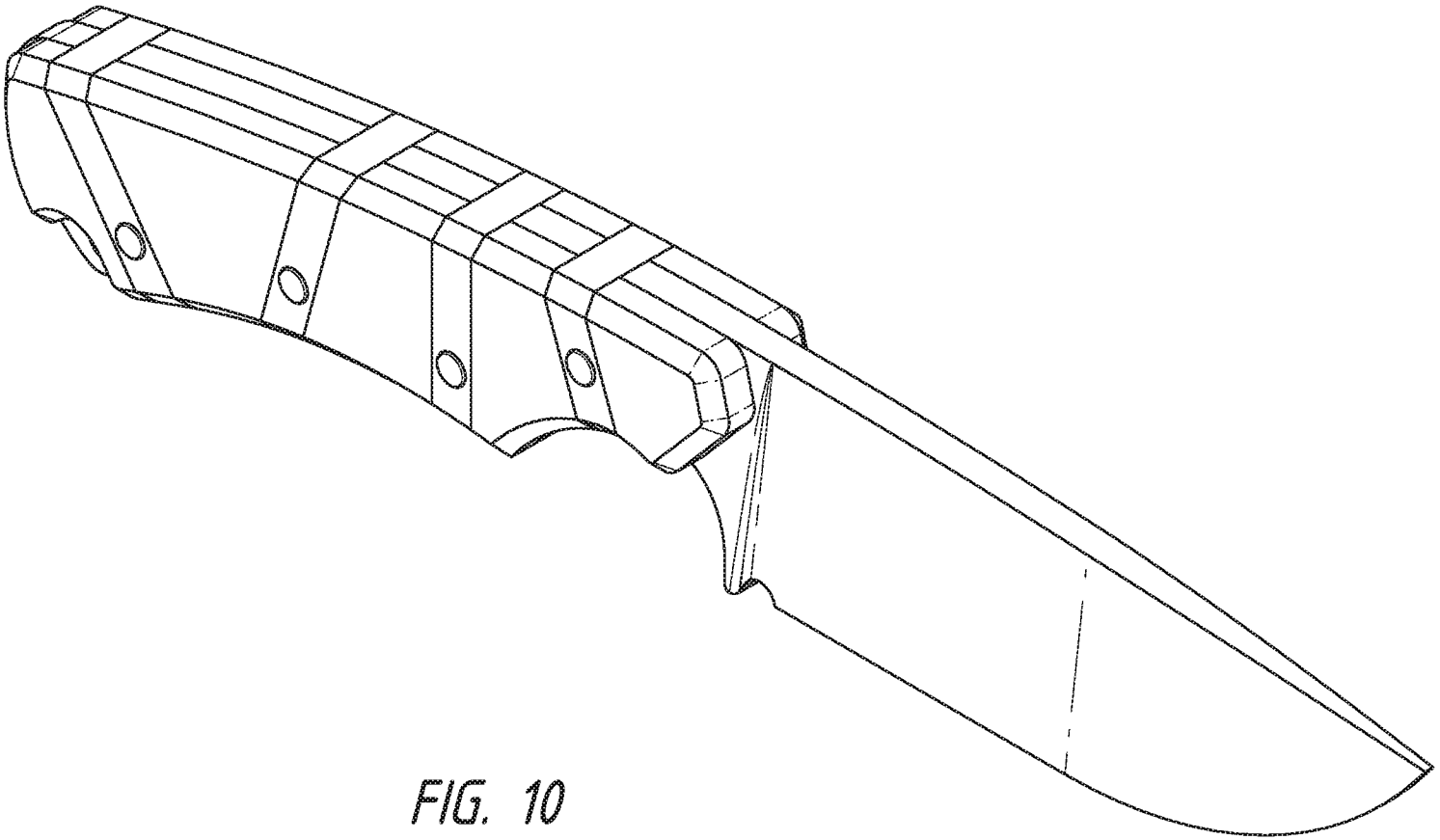
FIGS. 10-18 are views of knives in accordance with further examples herein showing ornamental aspects of a knife according to the present disclosure.
Figure 11:
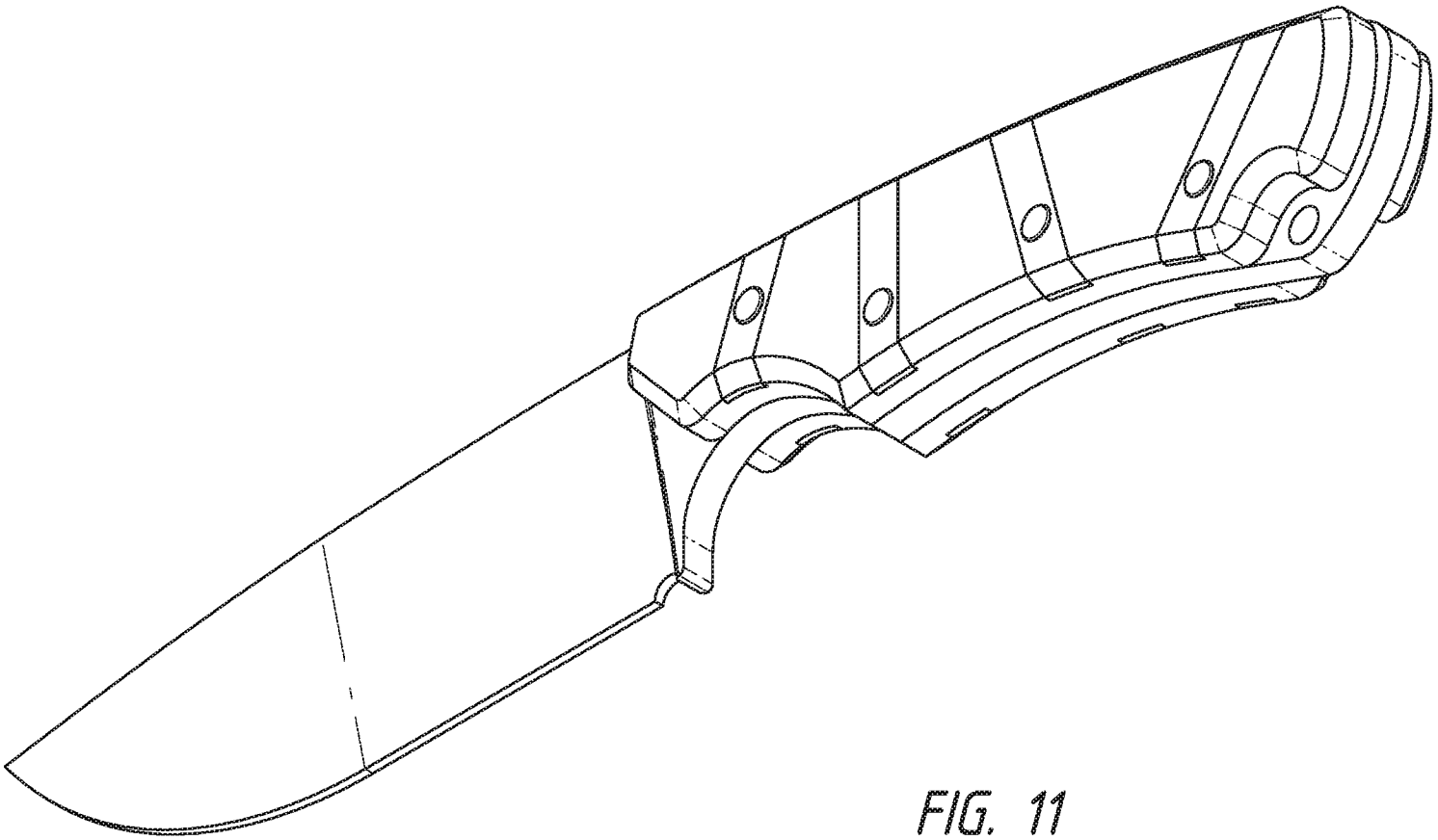
Figure 12:
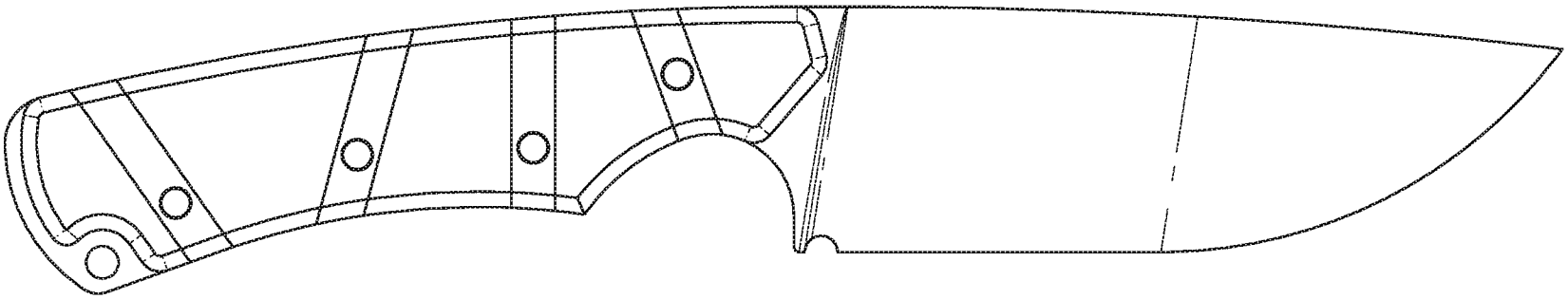
Figure 13:
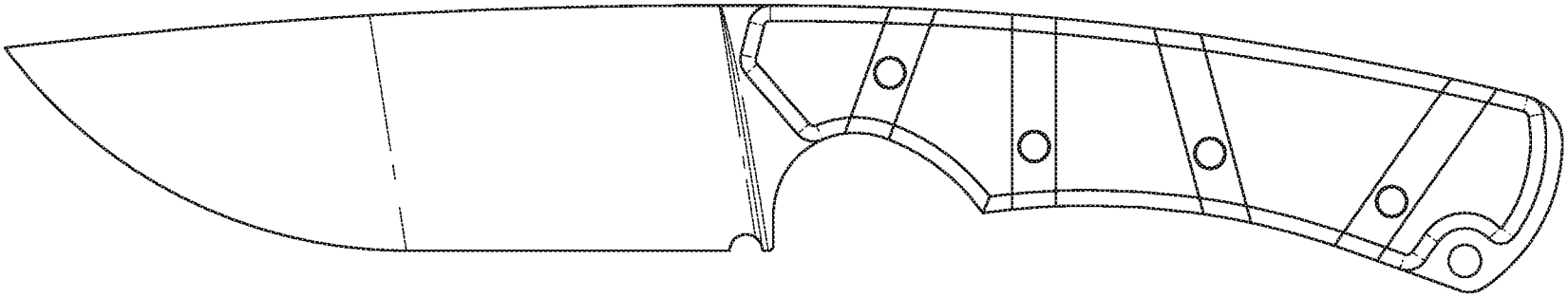
Figure 14:
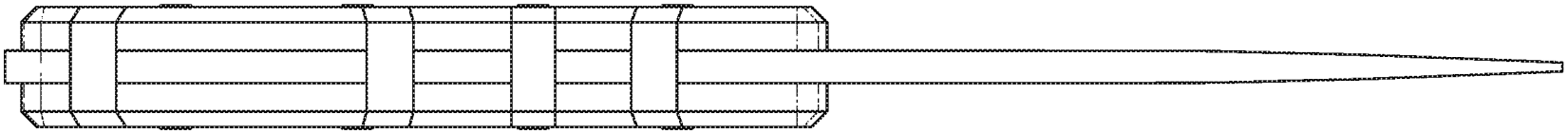
Figure 15:
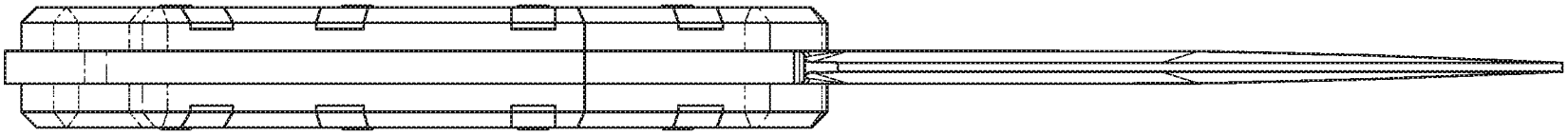
Figure 17:
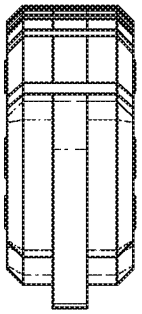
Figure 16:
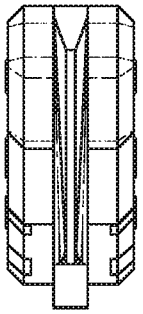

FIGS. 10-18 are views which illustrate various ornamental aspects of a knife according to the present disclosure. FIGS. 10 and 11 show first and second isometric views, and FIGS. 12-17 show right side elevational, left side elevational, top, bottom, front and rear views, respectively, of a knife according to one embodiments of the present disclosure. FIGS. 18A and 18B are an isometric and a right side view of a knife according to a second embodiment. The left side view of the knife in FIGS. 18A and 18B is a mirror image of the right side view shown in FIG. 18B. The remaining views (e.g., top, bottom, front and rear views) of the knife in FIG. 18A are the same as those shown in FIGS. 14-17. The design of a knife according to the present disclosure may, in other embodiments, exclude one or more of the features shown in solid line in FIGS. 10-18, or may include design elements combined from any of the embodiments disclosed herein.

In some embodiments, the knife may be a folding knife in that the blade may be rotatable about the handle (e.g., along direction 701) such that the blade can be concealed, at least partially, within the handle. A folding knife according to the present disclosure may include a blade which is pivotally connected to a handle at a blade pivot (e.g., near the hilt of the knife). The handle may include a pair of opposing scales spaced apart from one another and coupled to one another via a scale attachment system comprising a plurality of clips. The scales may be supported in the spaced apart relationship, at least in part by the clips. In preferred embodiments, the clips may be configured such that they wrap at least partially around a transverse perimeter side (e.g., the spine side) of the handle.

Figure 19:
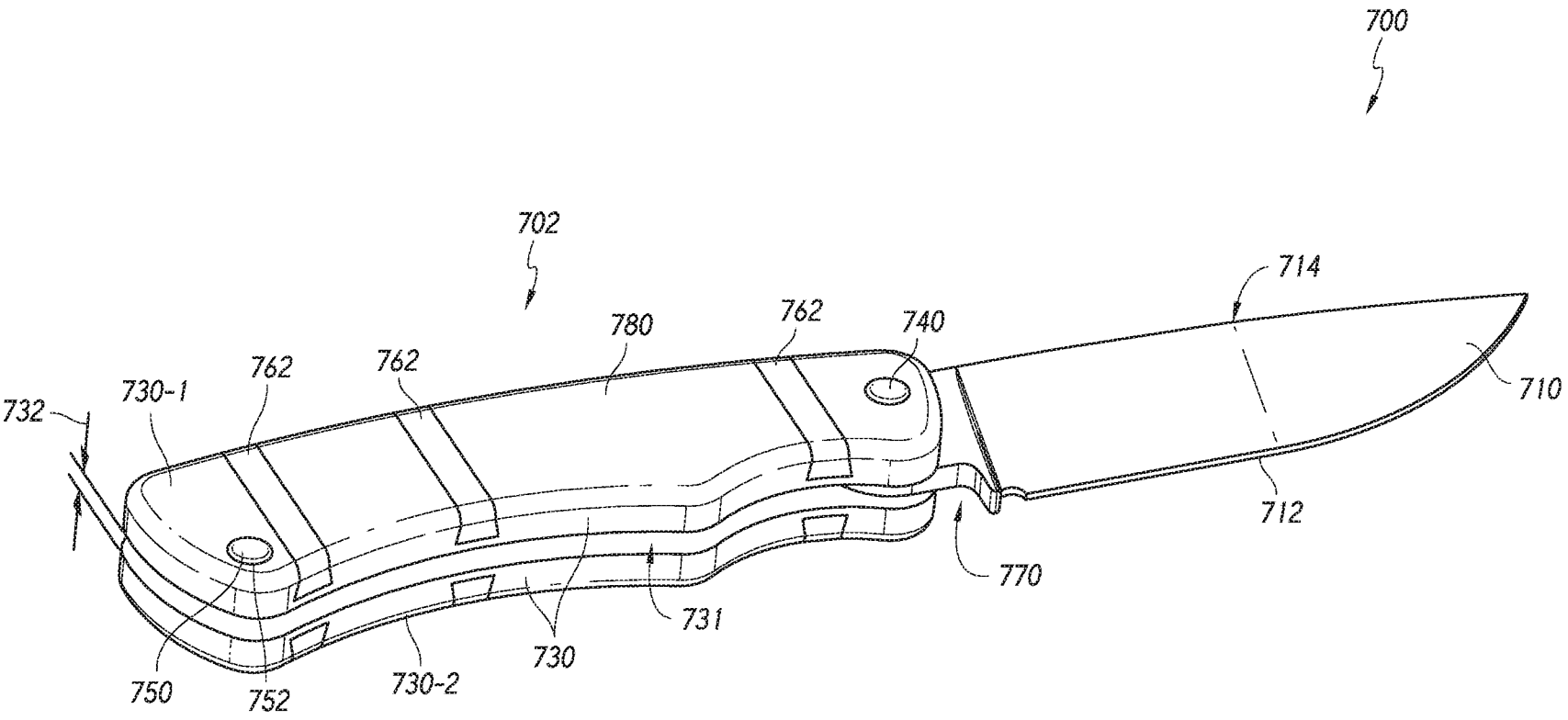
FIG. 19 is an isometric view of a folding knife, looking at the grip side of the knife handle, according to further examples of the present disclosure.
Figure 20:
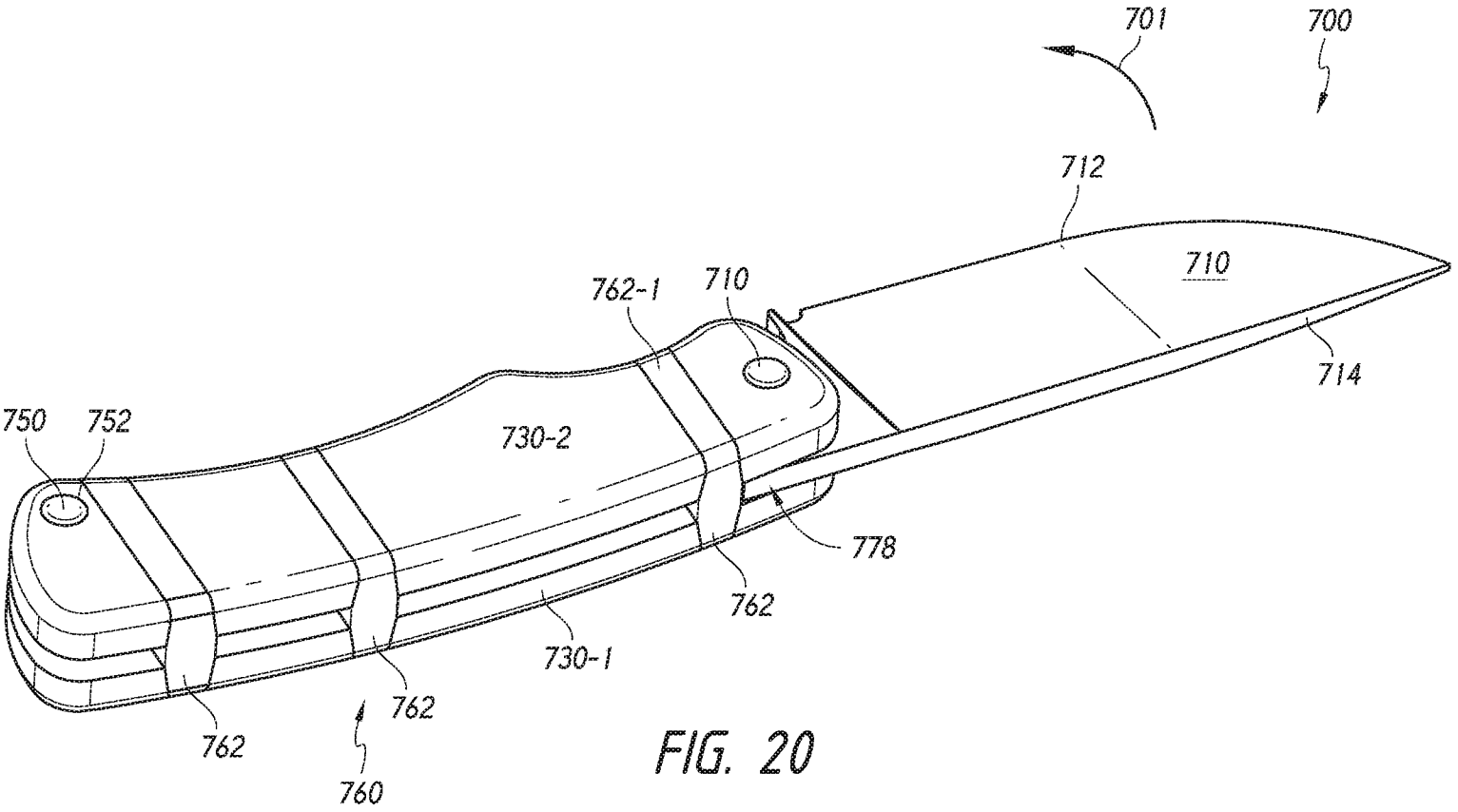
FIG. 20 is another isometric view of the folding knife in FIG. 19, looking at the spine side of the handle.
Figure 21:
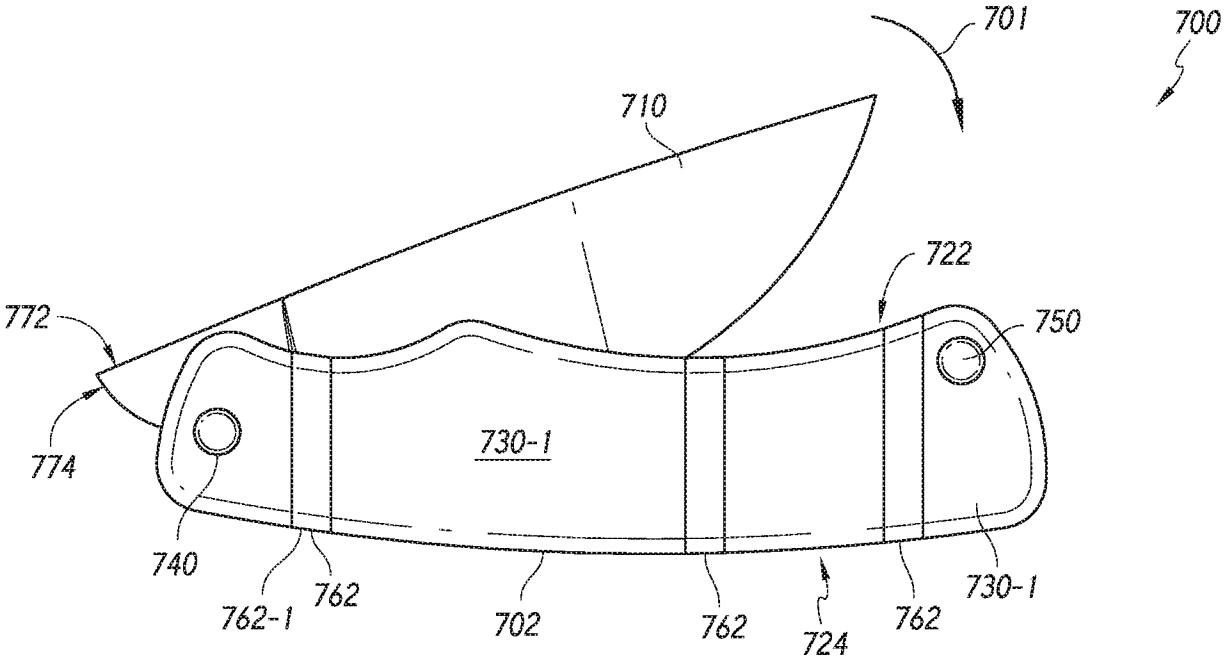
FIG. 21 is a side view of the folding knife in FIG. 19 with the blade shown in a partially folded position.
Figure 22:
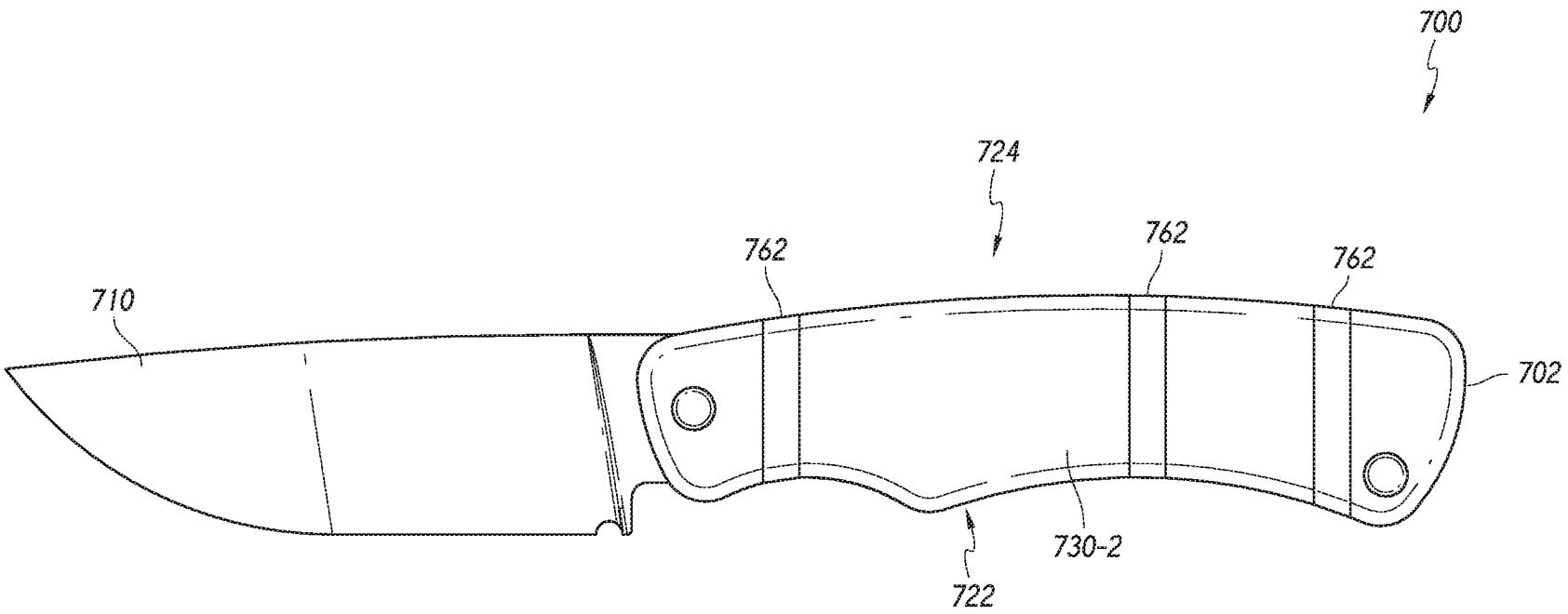
FIGS. 22-24 show further views of the knife in FIG. 19 illustrating steps of removing the scales of the knife in accordance with the examples herein.
Figure 23:
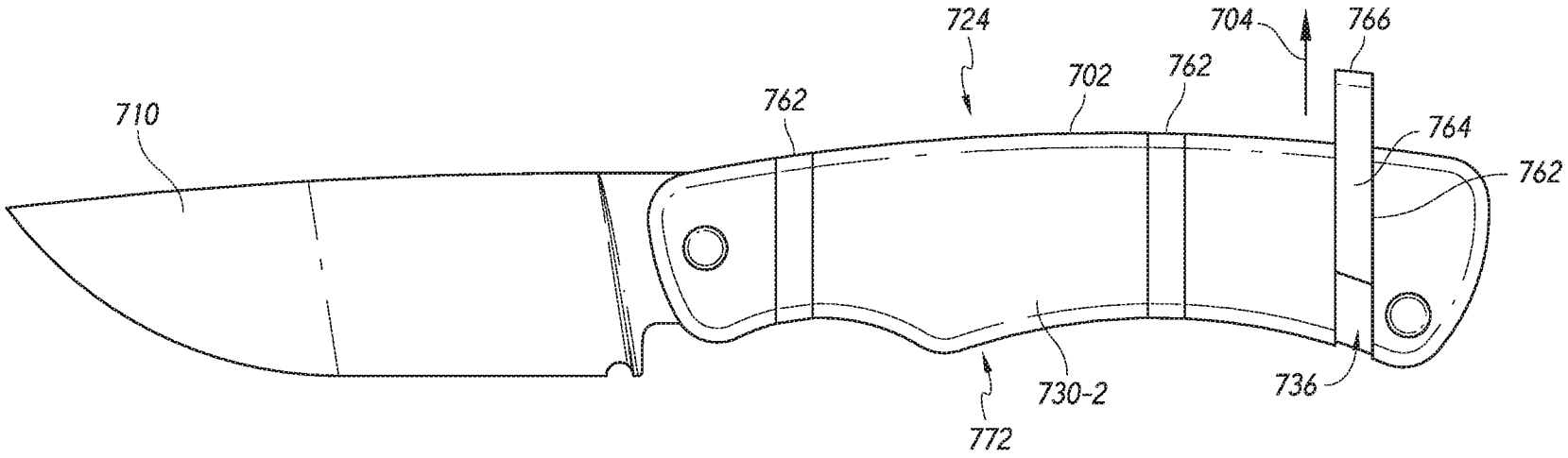
Figure 24:
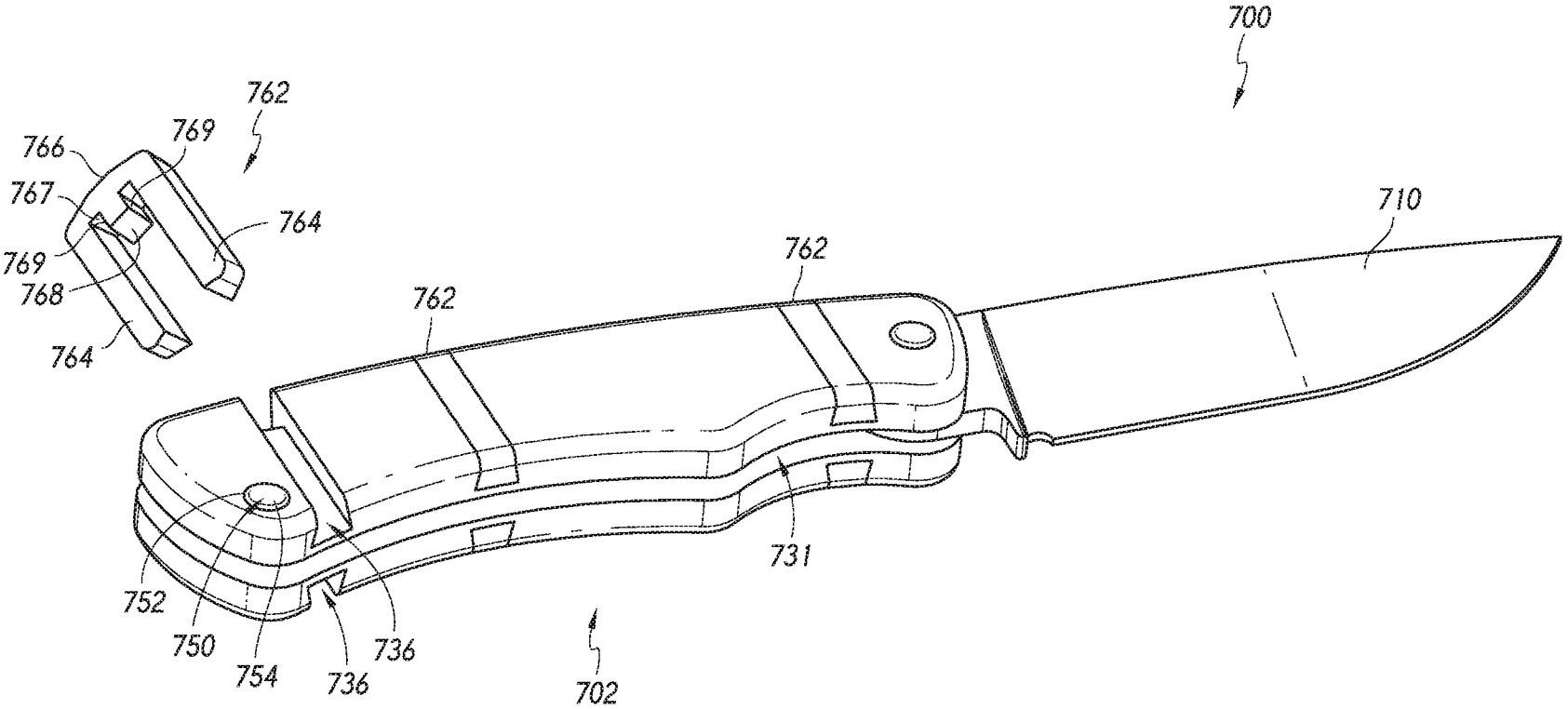

Referring now also to FIGS. 19-24, a folding knife according to the present disclosure is described in further detail below. FIGS. 19 and 20 show isometric views of the knife 700. FIG. 21 shows a right side view of the knife 700 with the blade partially folded into the handle. FIGS. 22-24 show left side views of the knife 700 and components thereof, illustrating a sequence of removing component(s) of the handle 702 of the knife 700, e.g., for replacing the clips and/or scales of the knife 700. The components and arrangement thereof in FIGS. 19-24 is exemplary only and variations, such as adding, removing, combining, or rearranging components are all contemplated.

Similar to knife 100, knife 700 includes a blade 710 and a handle 702. The blade includes a blade edge 712 and a spine 714. The handle 702 includes a pair of scales 730 arranged such that they are spaced apart from one another by a cavity 731 defined between the inward-facing sides of the scales 730. The first and second scales 730-1 and 730-2 are joined by a scale attachment system 760 including a plurality of clips 762. The clips 762 are removably received within corresponding grooves 736 formed on the outward-facing sides 780 of each of the scales 730. Similar to the clips 210, each of the clips 762 includes a pair of substantially parallel legs 764 connected by a spine portion 766. Each of the clips 762 is configured for a cooperating (e.g., a tolerance) fit with the corresponding grooves 736 in the scales 730. The transverse cross-section of a given leg 764 may match the transverse cross-section of the corresponding groove which receives the given leg such that the clips fit snugly (e.g., without substantial free play between the receiving and received components).

In the illustrated embodiment, the legs 764 and grooves 736 are shaped to form a dovetail joint, with the wider part of the dovetail joint positioned closer to the inward-facing side of the scales and the narrower part of the dovetail joint positioned at the outward-facing side of the scales. In this manner, the clips 762 may only be coupled and decoupled from the scales by movement in the direction along the length of the groove 736 (e.g., by insertion from the top or spine side 724 toward the bottom or grip side 722). Advantageously, the clips 762 are configured to mechanically limit or prevent movement of the scales 730 toward one another when one the clips 762 are inserted into the grooves 736. This allows the clips 762 to maintain the spacing between the scales, which can advantageously be achieved without any additional intermediate components between the scales. However, it will be appreciated that in some embodiments one or more additional intermediate components, e.g., to maintain or define the spacing, may be provided. In some embodiments, the clips 762 may additionally or alternatively include a projection 768 extending from the inward-facing side 767 of the spine portion 766 (see FIG. 24). The projection 768 may be integrally formed with the spine portion 766 (e.g., during the machining of the individual clips form stock material) and may function as a spacer such that inward-facing sides of the scales 730 rest on the opposite sidewalls 769 of the projection 768. In this examples, the width of the projection (i.e., the distance between the sidewalls 769) defines the width 732 of the cavity 731, which is selected to be sufficiently wide to accommodate the thickness of the blade 710 therebetween. In some embodiments, the handle 702 may alternatively or additionally include a spacer at the butt-end joint 750, which may improve the rigidity of the handle 702. For example, a separable washer (not shown), having a thickness equal to the width 732 of the cavity 731, may be placed between the inward-facing sides of the scales 730. One or more fasteners, received through the fastener holes 752 on the scales, may be used to fix the scales 730 to the spacer, which may have a threaded aperture to receive the thread of the fastener 754. In yet further examples, one or both of the scales 730 may include a boss structure projecting from the inward-facing side of the scale to provide the spacer. In some such embodiments, a single fastener 754 which is threaded received in the opposite scale, may be used. Alternative arrangements for maintaining the spacing between the scales may be used.

In yet further embodiments, the clips may additionally or alternatively be joined to each scale in a similar fashion as with the embodiment in FIG. 1. In some such embodiments, the clips may not be dovetailed with the scales but may instead be joined by one or more fasteners passing through the thickness of the legs 764 and partially into the thickness of the underlying scale 730. In such embodiments, the clips may have fastener holes and the scales may have corresponding fastener holes, which may be threaded to receive the clip fasteners. The clip fasteners may be shorter in length than the fasteners at the blade pivot and at the butt-end joint 750 so as to not protrude into the cavity 731.

Referring further to FIGS. 22-24, a sequence for disassembling the handle and/or removing components of the handle is described. FIG. 22 shows the knife 700 in an assembled state, FIG. 23 shows the knife 700 with one of the clips 762 partially removed, and FIG. 24 shows the knife 700 with the clip 762 fully removed. While the knife 700 is shown here with the blade 710 extended, it will be understood that the removal or disassembly sequence, and consequently a coupling or assembly sequence, may be performed with the blade retracted into the cavity 731. As shown in FIG. 23, to replace the clips, for example with clips of different material or color (e.g., differently treated or coated metal), the user slides each of the clips 762 along the direction 704 extending along the length of the groove 736 and out of engagement with the scales (e.g., as shown in FIG. 24). The step may be preceded by removal of the fastener 754, if used in a given embodiment, which may allow some additional free play at the butt end of the knife for easier removal of the clips. In other embodiments, in which the clips are additionally or alternatively secured with fasteners, the user would first remove the fasteners to enable removal of the clips. Once all of the clips and any fasteners such as 754 and 744 have been removed, the scales can be separated from the blade 710 and replaced with a different set of scales (e.g., from a different material and/or of different color, shape, etc.). In some cases, the user may wish to only replace the clips, e.g., for a different look, in which case the individual clips may be replaced one at a time in sequence without disassembling the handle (e.g., replacing one clip while the others hold the handle joined and/or without removal of the fasteners 754 744).

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall be open ended and have the same meaning as the word "comprising" and variants thereof (e.g., "comprise" and "comprises").

What is claimed is:

1. A knife having a handle, the knife comprising:

a blade having a tang and comprising a blade edge and a spine;

first and second opposing scales removably coupled to the blade to form a handle comprising a spine side proximate the spine, wherein the first and second scales are provided in a spaced apart arrangement to accommodate the tang therebetween, wherein each of the first and second scales comprises a plurality of grooves formed on an outwardly-facing side of the respective scale, wherein each of the plurality of grooves comprises a first portion formed in the outward facing side of the respective scale and connects to a second portion formed in a side of the respective scale adjacent to the outward facing side; and a scale attachment system comprising a plurality of clips, each comprising a first portion removably received in a respective groove of the first scale, a second portion removably received in a respective groove of the second scale, and a connecting portion joining the first and second portions and which extends across and is visible on the spine side of the handle, and wherein the connecting portion of each of the plurality of clips engages a spine side of the tang.

2. The knife of claim 1, wherein the tang is integrally formed with the blade, the tang having a grip side and opposite first and second tang sides extending between the grip side and the spine side of the tang, and wherein the first scale is disposed against the first tang side and the second scale is disposed against the second tang side when the knife is in the handle is assembled.

3. The knife of claim 2, wherein the connecting portion of each of the plurality of clips is received in a corresponding slot on the spine side of the tang.

4. The knife of claim 2, wherein the first scale is co-extensive with the first tang side and the second scale is co-extensive with the second tang side.

5. The knife of claim 2, wherein the tang includes at least one weigh-balance feature.

6. The knife of claim 2, wherein the at least one balance feature includes a through aperture formed in a portion of the tang concealed by the first and second scales when the knife is in the assembled configuration.

7. The knife of claim 2, wherein one or more of the plurality of clips has a different geometry from an adjacent clip.

8. The knife of claim 1, wherein each of the plurality of clips is retained in the respective groove by at least one fastener.

9. The knife of claim 8, wherein each of the plurality of clips is attached to the handle by at least two fasteners.

10. The knife of claim 9, wherein the at least two fasteners attaching a given clip to the handle are co-axially aligned with one another in the assembled configuration.

11. The knife of claim 1, wherein each of the plurality of clips and the respective groove are configured for a cooperating fit with one another, wherein the cooperating fit constrains relative movement between the clip and the respective groove in all but one degree of freedom.

12. The knife of claim 11, wherein the cooperating fit is a dovetail fit between the clip and the respective groove.

13. The knife of claim 1, wherein each of the plurality of clips is retained in the respective groove by a cooperating fit between the clip and the respective groove.

14. The knife of claim 1, wherein the plurality of clips includes at least three clips.

15. The knife of claim 14, wherein the plurality of clips are parallel to one another when the handle is the assembled.

16. The knife of claim 1, wherein the connecting portion of each of the plurality of clips is configured to position the first and second scales in the spaced apart arrangement.

17. The knife of claim 16, wherein the connecting portion of each of the plurality of clips includes a protrusion extending from an inwardly-facing side of the connecting portion.

18. The knife of claim 1, wherein the knife is a folding knife, and wherein the one of the plurality of clips is positioned proximate to the blade such that the clip limits rotation of the blade when rotating the blade from a folded configuration to an unfolded configuration.

19. A knife kit including the knife of claim 1, the kit comprising a single blade and at least two different sets of first and second scales, at least two different sets of clips, at least two different sets of fasteners, or any combination thereof.

20. A knife with a handle having removable scales, the knife comprising:

a blade comprising a blade edge and a spine;

a tang integrally formed with the blade, the tang comprising a grip side, a spine side, and opposite first and second tang sides extending between the grip side and the spine side;

a first scale and a second scale, each disposed on and coextensive with at least a portion of the respective one of the first and second tang sides; and a scale attachment system for removably attaching the first and second scales to the tang, the scale attachment system comprising a plurality of clips, each comprising a first portion received in a respective groove in the first scale, a second portion received in a respective groove in the second scale, and a connecting portion joining the first and second portions, wherein the connecting portion extends transversely across the spine side of the tang engaging the spine side of the tang, and a plurality of fasteners removably received in respective fastener holes in the clips for removably attaching each of the plurality of clips to the tang thereby removably attaching the respective ones of the first and second scales to the tang.

* * * * *